US008038138B2

(12) United States Patent
Iguchi

(10) Patent No.: US 8,038,138 B2
(45) Date of Patent: Oct. 18, 2011

(54) HOLDING UNIT HAVING DELAYED CONVEYANCE TIME

(75) Inventor: Ken Iguchi, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/970,917

(22) Filed: Dec. 16, 2010

(65) Prior Publication Data

US 2011/0148024 A1 Jun. 23, 2011

Related U.S. Application Data

(63) Continuation of application No. 12/207,437, filed on Sep. 9, 2008, now Pat. No. 7,874,551.

(60) Provisional application No. 60/971,553, filed on Sep. 11, 2007, provisional application No. 60/971,554, filed on Sep. 11, 2007.

(51) Int. Cl.
*B65H 37/04* (2006.01)

(52) U.S. Cl. ..... 270/58.11; 270/58.08; 270/58.14

(58) Field of Classification Search ..... 270/58.08, 270/58.11, 58.14
See application file for complete search history.

(56) References Cited

U.S. PATENT DOCUMENTS

| | | | | |
|---|---|---|---|---|
| 5,112,034 | A * | 5/1992 | Uto et al. | 270/58.12 |
| 5,765,824 | A * | 6/1998 | Kawano et al. | 270/58.11 |
| 6,199,850 | B1 * | 3/2001 | Seki | 270/58.07 |
| 6,219,503 | B1 * | 4/2001 | Miyake et al. | 399/85 |
| 6,332,606 | B1 * | 12/2001 | Seki | 270/59 |
| 6,427,997 | B1 * | 8/2002 | Hirota et al. | 270/58.12 |
| 7,111,838 | B2 * | 9/2006 | Sasa et al. | 270/58.11 |
| 7,165,764 | B2 * | 1/2007 | Nakamura et al. | 270/58.11 |
| 7,192,020 | B2 * | 3/2007 | Hayashi et al. | 270/58.11 |
| 7,413,178 | B2 * | 8/2008 | Fujii et al. | 270/58.11 |
| 7,874,551 | B2 * | 1/2011 | Iguchi | 270/58.11 |
| 2005/0067748 | A1 * | 3/2005 | Fujii et al. | 270/58.08 |

FOREIGN PATENT DOCUMENTS

| | | | |
|---|---|---|---|
| JP | 04148993 | A * | 5/1992 |
| JP | 09227013 | A * | 9/1997 |
| JP | 2000143055 | A * | 5/2000 |
| JP | 2000177912 | A * | 6/2000 |
| JP | 2003171057 | A * | 6/2003 |
| JP | 2004075374 | A * | 3/2004 |
| JP | 2005350269 | A * | 12/2005 |
| JP | 2006027769 | A * | 2/2006 |

* cited by examiner

*Primary Examiner* — Patrick Mackey

(74) *Attorney, Agent, or Firm* — Patterson & Sheridan, LLP

(57) ABSTRACT

A finisher includes: a holding unit; a stapling unit; a discharge unit; and a control unit. The finisher forms a part of a second sheet bundle subsequent to a first sheet bundle until discharging the first sheet bundle. The holding unit receives a sheet of the first sheet bundle and the subsequent sheet within a first period. The holding unit receives the last sheet of the first sheet bundle and a first sheet of the second sheet bundle within a second period as same length as the first period. The holding unit receives a sheet of the second sheet bundle and the subsequent sheet within a third period different from the second period in time length.

11 Claims, 22 Drawing Sheets

| | LARGE NUMBER OF SHEETS | SMALL NUMBER OF SHEETS |
|---|---|---|
| LARGE SHEET SIZE | HIGH SPEED | LOW SPEED |
| SMALL SHEET SIZE | INTERMEDIATE SPEED | ULTRA-LOW SPEED |

FIG. 14

CASE SWITCHED FROM TWO-SHEET STAPLING TO THREE-SHEET STAPLING

CASE SWITCHED FROM TWO-SHEET AND TWO-POSITION STAPLING TO THREE-SHEET STAPLING AND ONE-POSITION STAPLING (MAXIMUM NUMBER OF BUFFERED SHEETS: 3)

CASE SWITCHED FROM TWO-SHEET AND TWO-POSITION STAPLING TO FIVE-SHEET STAPLING AND TWO-POSITION STAPLING (MAXIMUM NUMBER OF BUFFERED SHEETS: 5)

HOLDING UNIT HAVING DELAYED CONVEYANCE TIME

CROSS-REFERENCE TO RELATED APPLICATIONS

This application is a continuation of U.S. Ser. No. 12/207,437 Filed Sep. 9, 2008, which is based upon and claims the benefit of priority from: U.S. provisional application 60/971,553, filed on Sep. 11, 2007; and U.S. provisional application 60/971,554, filed on Sep. 11, 2007, the entire contents of each of which are incorporated herein by reference.

TECHNICAL FIELD

The present invention relates to a finisher and an image forming apparatus and a sheet conveying method. In particular, the invention relates to a finisher that can control a delay time in post-processing and an image forming apparatus having the finisher, and a sheet conveying method that can control a delay time in post-processing.

BACKGROUND

In recent years, electrophotographic image forming apparatuses such as laser printers, digital copiers, and laser facsimiles were provided with a post-processing device (finisher) stapling a sheet bundle. When sheets discharged from an image forming unit are subjected to the post-processing, the throughput of a stapler increases depending on the timing for stapling. Accordingly, even when sheets are discharged from the image forming unit with a usual sheet interval, the stapling of the stapler is delayed. Therefore, for example, in JP-A-4-148993, a finisher includes a mechanism buffering (holding) two or three sheets, and a delay time is provided between a sheet to be subjected to the post-processing and a sheet to be subjected later to the post-processing so as to smoothly staple the sheets at the time of forming an image at a high-speed.

For example, in JP-A-2006-27769, the control means for controlling to switch a first sheet gap control for forming an image with a sheet gap not including a post-processing time, a second sheet gap control for forming an image with a sheet gap including the post-processing time, a first post-processing carrying control for temporarily stopping a first sheet of a subsequent job in a carrying path before an intermediate stacker during performing the post-processing on a sheet bundle of a previous job, overlapping a first sheet and a second sheet of the subsequent job with each other, and carrying the overlapped sheets before the intermediate stacker after completing the post-processing of the previous job, and a second post-processing carrying control for temporarily stopping the first sheet of a subsequent job in the carrying path before the intermediate stacker during the post-processing on the sheet bundle of the previous job and carrying the temporarily-stopped sheet to the intermediate stacker after completing the post-processing of the previous job is provided.

However, in JP-A-4-148993, there is no problem when the processing is continued with the same sheet gap, but an extra standby time is added when a mode with a long sheet gap is switched to a mode with a short sheet gap, thereby deteriorating the performance of the image forming process. For example, when the two-position stapling is continued, there is no problem. However, when the two-position stapling is switched to the one-position stapling, the delay time for the two-position stapling is taken, thereby adding the extra standby time.

SUMMARY

A finisher according to an aspect of the invention includes: a holding unit configured to sequentially collect a plurality of sheets to form a first sheet bundle; a support unit configured to receive the first sheet bundle; a stapling unit configured to staple the first sheet bundle on the support unit; a discharge unit configured to discharge the first sheet bundle stapled by the stapling unit from the support unit; and a control unit configured to control the holding unit to form a part of a second sheet bundle subsequent to the first sheet bundle until the discharge unit discharges the first sheet bundle, to control the holding unit to receive a sheet of the first sheet bundle and the subsequent sheet of the first sheet bundle within a first period, to control the holding unit to receive the last sheet of the first sheet bundle and a first sheet of the second sheet bundle within a second period as same length as the first period, and to control the holding unit to receive a sheet of the second sheet bundle and the subsequent sheet of the second sheet bundle within a third period different from the second period in time length.

An image forming apparatus according to another aspect of the invention includes: an image forming unit configured to sequentially form images on a plurality of sheets, respectively; a holding unit configured to sequentially collect the plurality of sheets to form a first sheet bundle; a support unit configured to receive the first sheet bundle; a stapling unit configured to staple the first sheet bundle on the support unit; a discharge unit configured to discharge the first sheet bundle stapled by the stapling unit from the support unit; and a control unit configured to control the holding unit to form a part of a second sheet bundle subsequent to the first sheet bundle until the discharge unit discharges the first sheet bundle, to control the image forming unit to output a sheet of the first sheet bundle and the subsequent sheet of the first sheet bundle within a first period, to control the image forming unit to output the last sheet of the first sheet bundle and a first sheet of the second sheet bundle within a second period as same length as the first period, and to control the image forming unit to output a sheet of the second sheet bundle and the subsequent sheet of the second sheet bundle within a third period different from the second period in time length.

An sheet conveying method according to another aspect of the invention includes: collecting sequentially a plurality of sheets to form a first sheet bundle; receiving the first sheet bundle; forming apart of a second sheet bundle subsequent to the first sheet bundle until discharging the first sheet bundle so that a first period between receiving a sheet of the first sheet bundle and receiving the subsequent sheet of the first sheet bundle is as same length as a second period between receiving the last sheet of the first sheet bundle and receiving a first sheet of the second sheet bundle, and a third period between receiving a sheet of the second sheet bundle and receiving the subsequent sheet of the second sheet bundle is different from the second period in time length; stapling the first sheet bundle; discharging the first sheet bundle; and receiving the second sheet bundle.

DESCRIPTION OF THE DRAWINGS

In the attached drawings,

FIG. 14 is a table showing the relations between the driving speed of a discharge roller and a bundle hook belt, the number of sheets, and the sheet size;

DETAILED DESCRIPTION

Hereinafter, embodiments of the invention will be described with reference to the drawings.

First Embodiment

Figure 1:
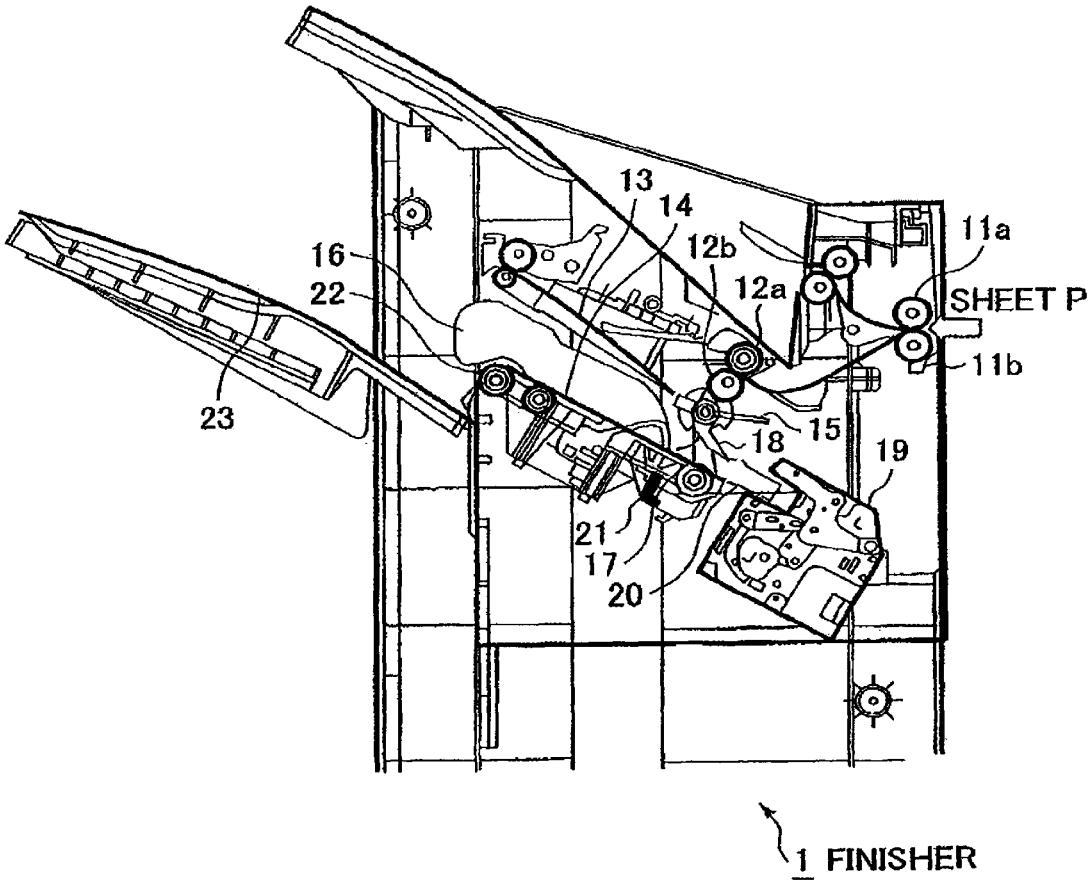
FIG. 1 is a view showing the configuration of a finisher according to an embodiment of the invention.

FIG. 1 shows the configuration of a finisher (post-processing device) 1 according to this embodiment. The finisher 1 is provided in an image forming apparatus.

Entry rollers 11*a* and 11*b* are a pair of rollers and receive a sheet P provided from outside of the finisher 1. The entry rollers 11*a* and 11*b* carry the received sheet P to exit rollers 12*a* and 12*b*. A standby tray 13 temporarily holds the sheet P carried from the exit rollers 12*a* and 12*b*. The finisher 1 opens the standby tray 13 and thus drops and supplies the temporarily held sheet P to a processing tray 14. A sheet guide 18 guides the rear end of the sheet P supplied to the processing tray 14, to a stapler 19. A lateral alignment board 16 laterally aligns the sheet P on the processing tray 14. A paddle 15 and a longitudinal alignment roller 17 abut the rear end of the sheet P on the processing tray 14 to a rear stopper 26 and thus longitudinally align the sheet P.

Figure 2:
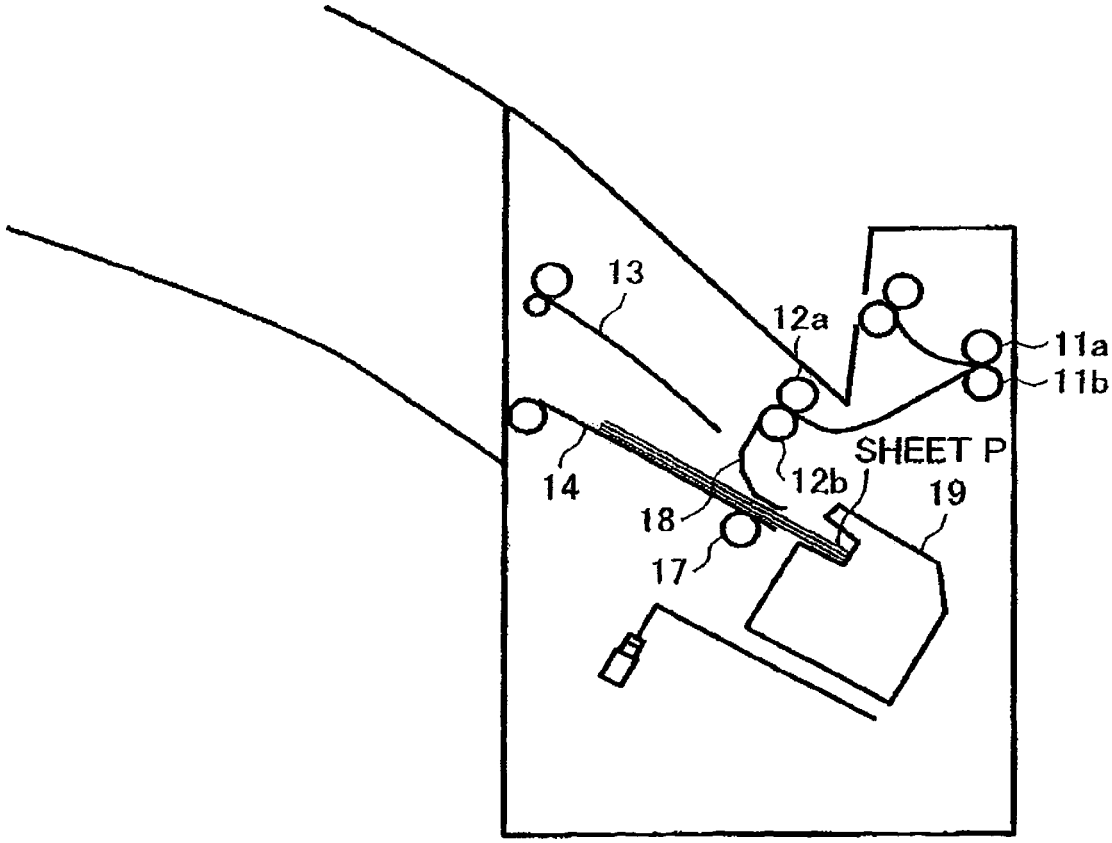
FIG. 2 is a view showing the state where a sheet bundle is guided to a stapler after it is sequentially guided to a processing tray via a standby tray.

As shown in FIG. 2, the sheet P is sequentially guided to the processing tray 14 via the standby tray 13 and then guided to the stapler 19 through the above process. The sheet guide 18 moves in a predetermined direction and enlarges its spacing from the processing tray 14. When the last page of the sheets P is guided to the stapler 19, the stapler 19 staples the sheet bundle of the guided sheets P. An ejector 20 has an eject arm. The ejector 20 pushes the sheet bundle stapled by the stapler 19 into the direction of a stack tray 23 and delivers the sheet bundle to a bundle hook belt 21. The bundle hook belt 21 has the sheet bundle hooked on a bundle hook 21*a* provided on the bundle hook belt 21 and discharges the sheet bundle to the stack tray 23 by interlocking with the discharge operation of a discharge roller 22. A bundle hook motor for driving the bundle hook belt 21 drives the ejector 20 via an electromagnetic spring clutch. The electromagnetic spring clutch transmits a drive force of the bundle hook motor to the ejector 20 by turning on the electromagnetic spring clutch.

Figure 3:
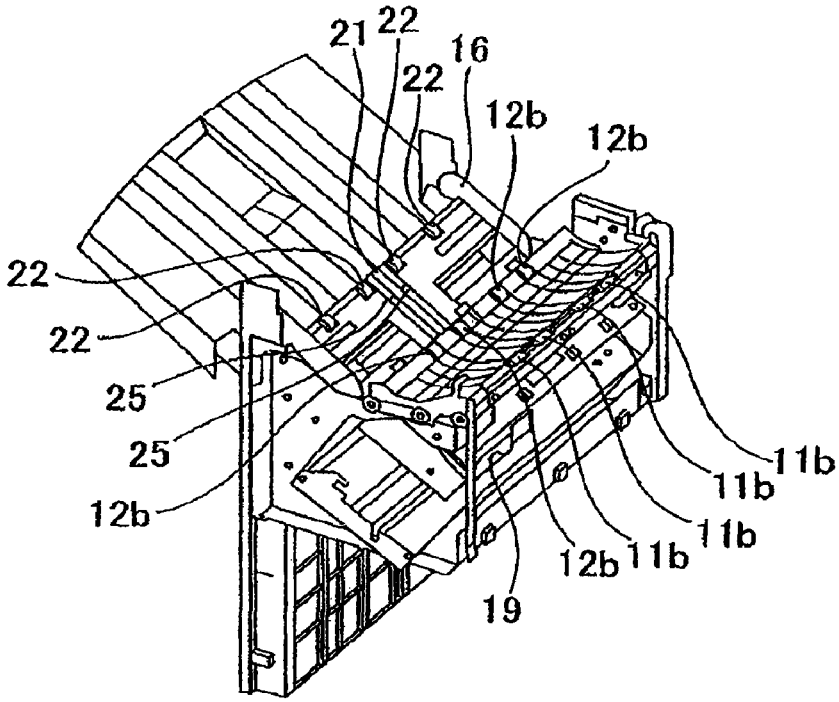
FIG. 3 is a perspective view of the finisher of FIG. 1.
Figure 4:
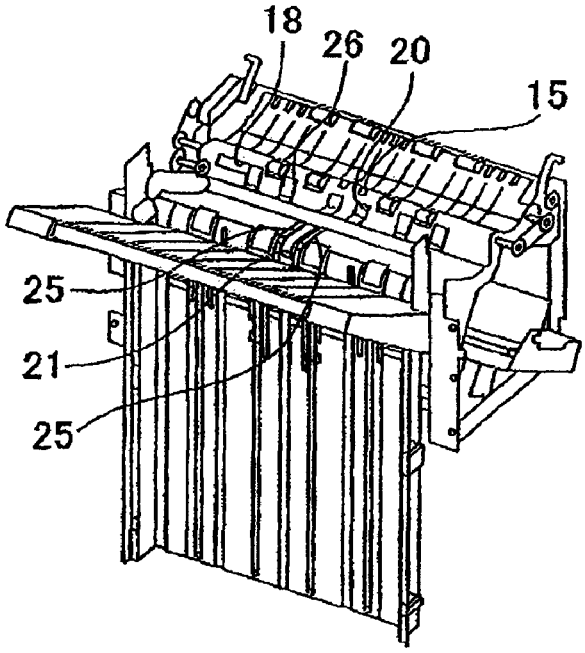
FIG. 4 is another perspective view of the finisher of FIG. 1.
Figure 5:
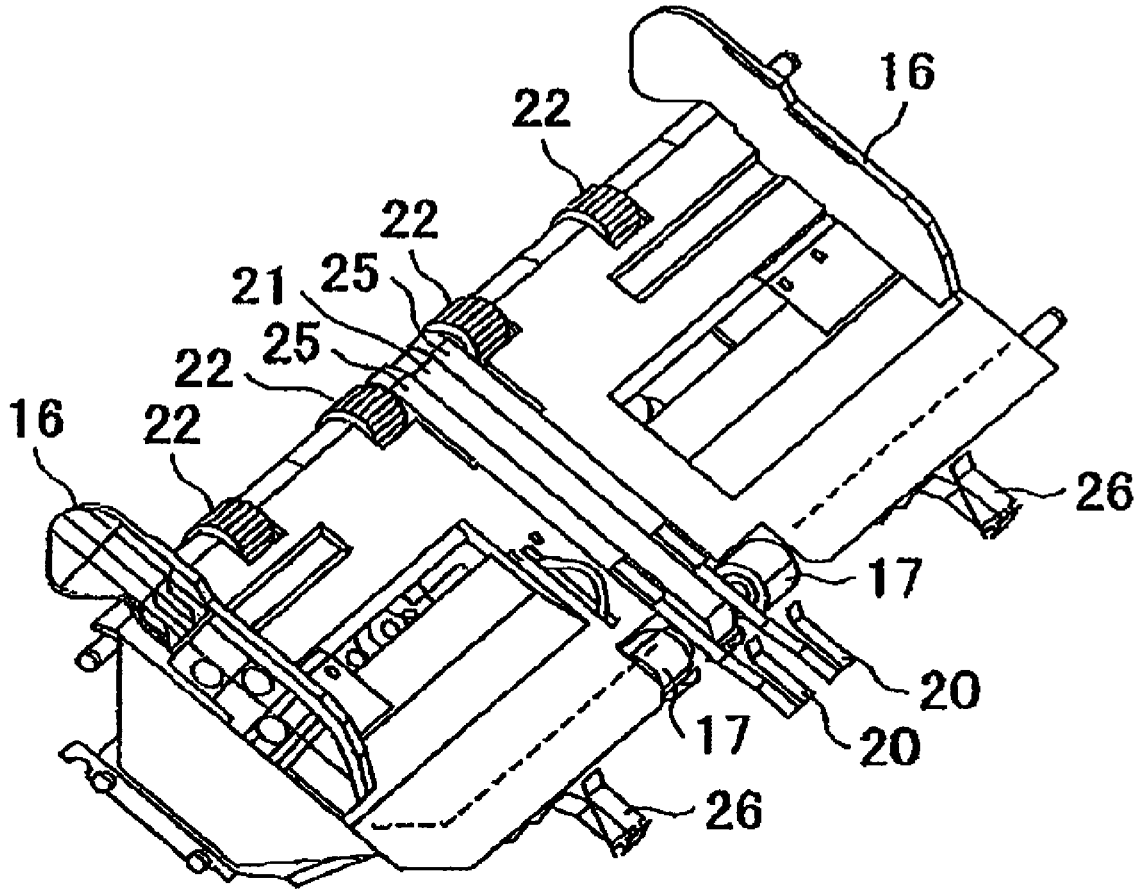
FIG. 5 is another perspective view of the finisher of FIG. 1.
Figure 6:
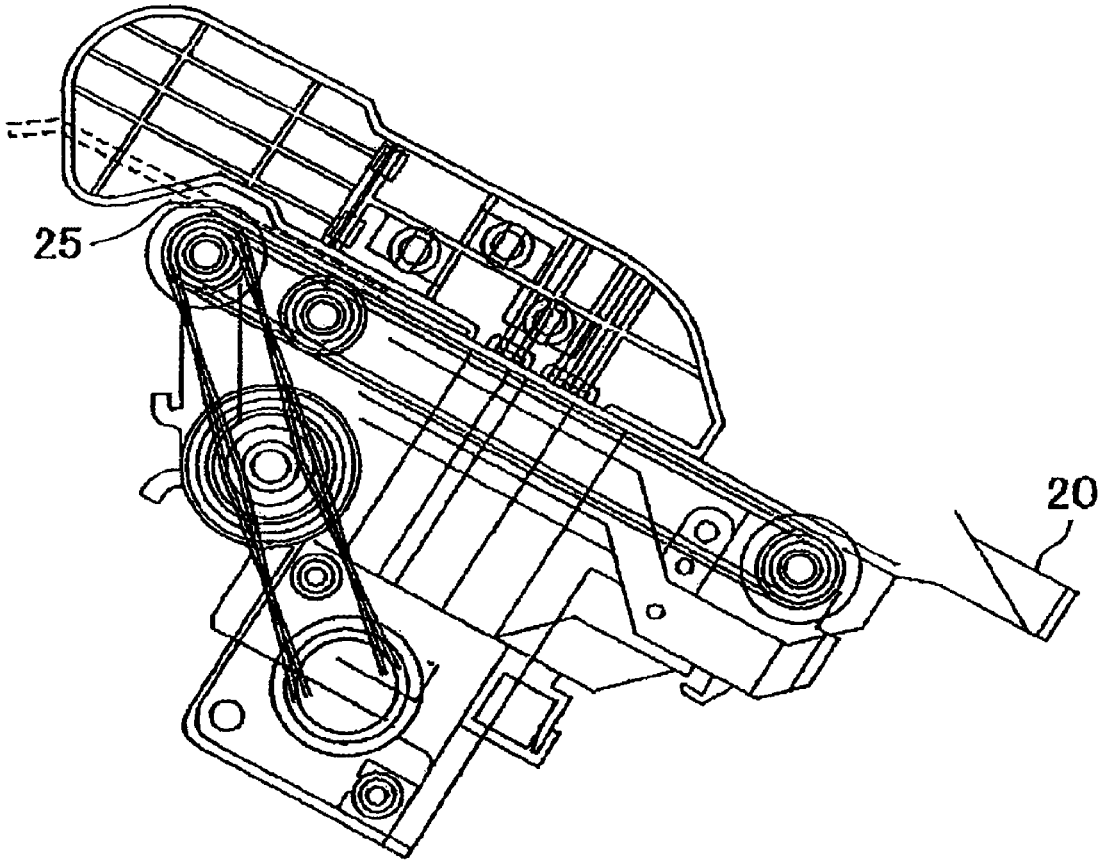
FIG. 6 is a sectional view of the finisher of FIG. 1.
Figure 7:
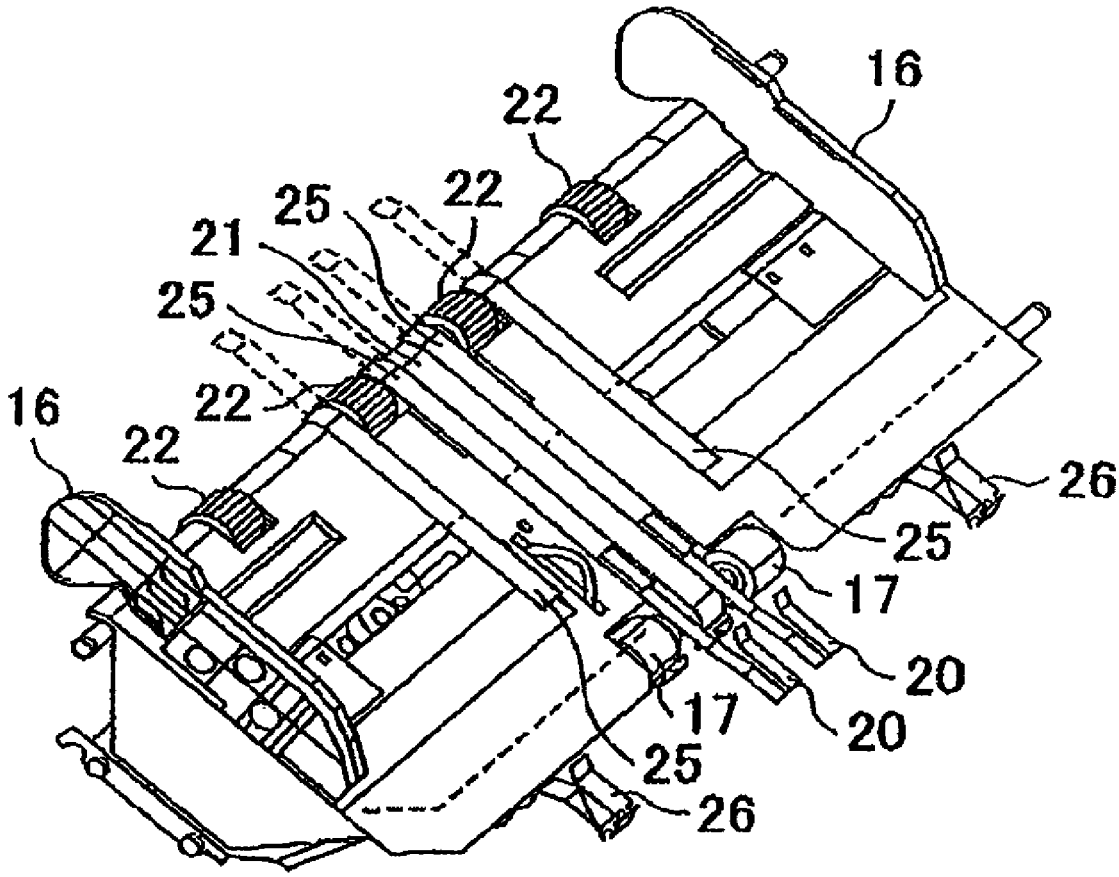
FIG. 7 is another perspective view of the finisher of FIG. 1.

FIG. 3 to FIG. 5 are perspective views of the finisher 1. A thrust bar 25 is integrally formed with the ejector 20 and a resin is bonded to its distal end. FIG. 6 is a sectional view of the finisher 1. FIG. 7 is a perspective view of a finisher 1 in which four thrust bars 25 are provided, which is different from the finisher 1 having two thrust bars 25 shown in FIG. 2 to FIG. 5.

Figure 8:
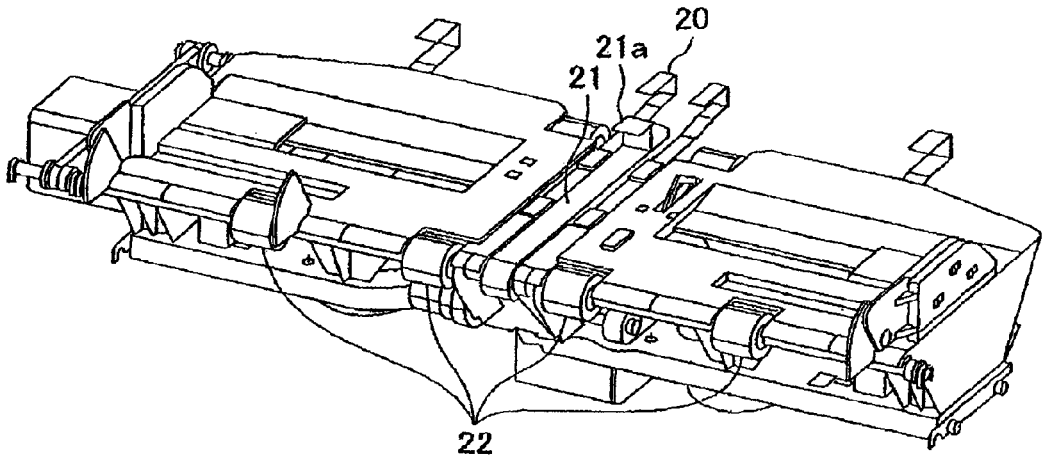
FIG. 8 is an explanatory view for explaining a sheet bundle discharge operation in the finisher.
Figure 9A:
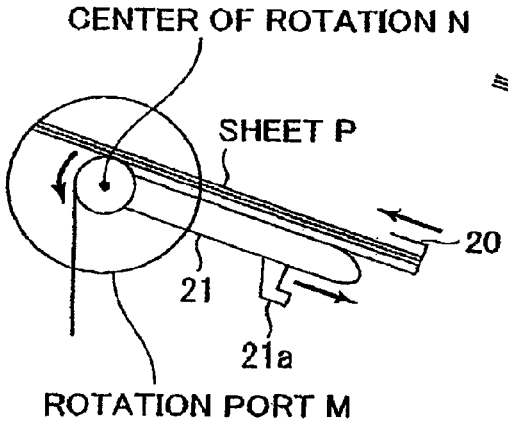
FIG. 9A and FIG. 9B are explanatory views for explaining a sheet bundle discharge operation in the finisher.
Figure 9B:
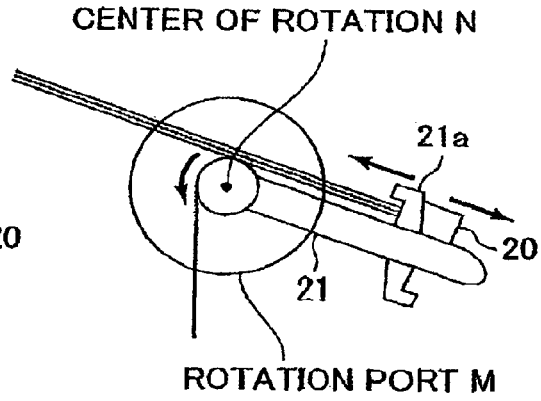

The sheet bundle discharge operation in the finisher 1 will now be described with reference to FIG. 8, FIG. 9A and FIG. 9B. When stapling of a sheet bundle is completed, the ejector 20 is driven as the electromagnetic spring clutch is turned on and its driving is transmitted. Also, the bundle hook belt 21 and the discharge roller 22 are driven substantially at the same time. As shown in FIG. 9A and FIG. 9B, the bundle hook 21*a* of the bundle hook belt 21 overtakes the ejector 20 and receives the sheet bundle from the ejector 20. Then, the bundle hook 21*a* hooks the sheet bundle and discharges the sheet bundle to the stack tray 23 by interlocking with the discharge operation of the discharge roller 22. The bundle hook 21*a* moves along curved track which is located at a distance r from a center of rotation N, in order to back to a home position of the bundle hook 21*a* after discharging the sheet bundle. Apart in which the bundle hook 21*a* is rotated is defined as rotation part M.

Figure 10:
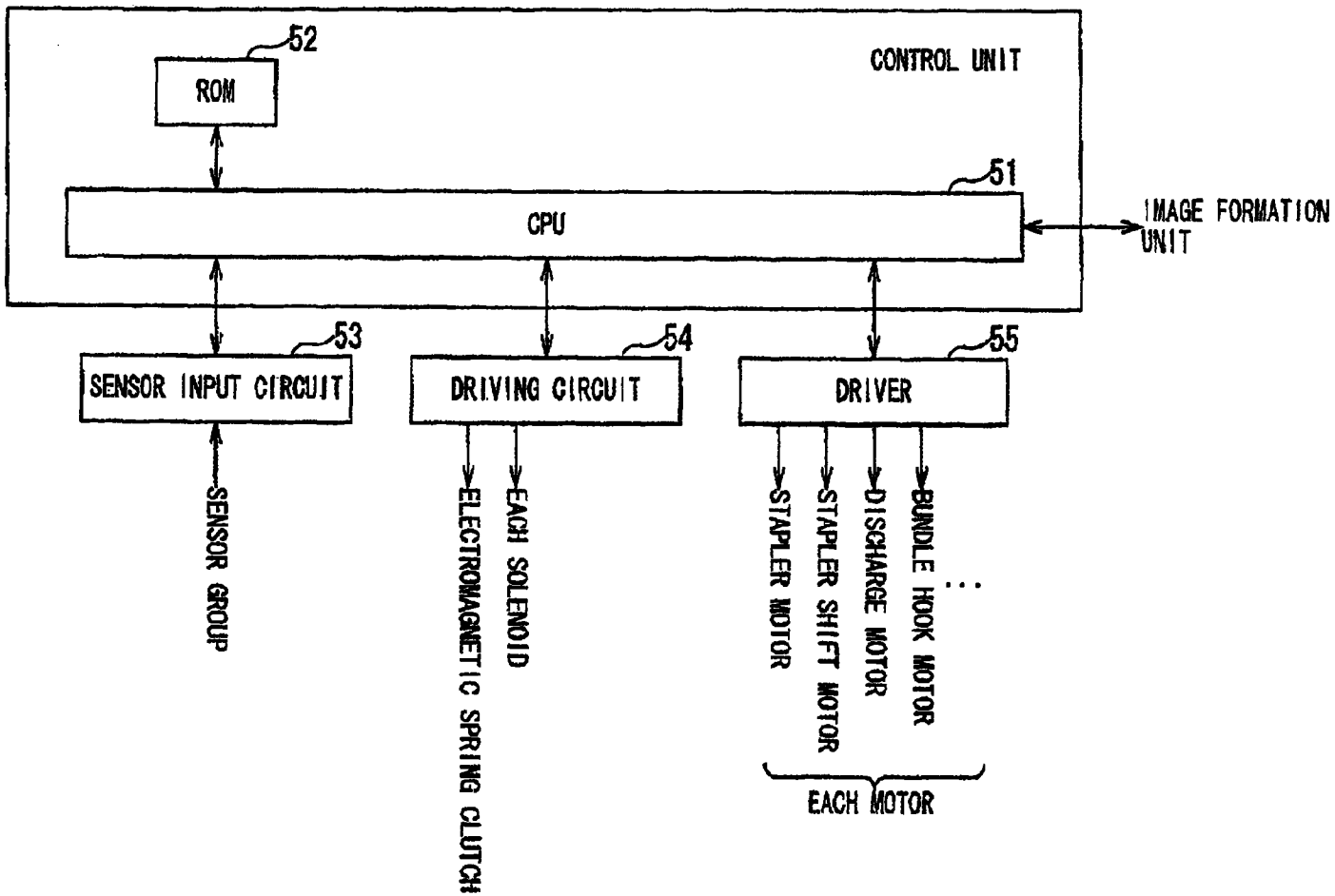
FIG. 10 is a block diagram showing a schematic internal configuration of a control system of the finisher according to the embodiment.

FIG. 10 shows a schematic internal configuration of a control system of the finisher 1 according to the embodiment. As shown in FIG. 10, the control system of the finisher 1 includes a central processing unit (CPU) 51, a read-only memory (ROM) 52, a sensor input circuit 53, a driving circuit 54, a driver 55 and so on. The CPU executes various processing in accordance with various application programs stored in the ROM 52 and also generates various control signals and supplies them to each part, thereby comprehensively controlling the finisher 1. The ROM 52 properly stores necessary data for the CPU 51 to execute various processing. The sensor input circuit 53 supplies inputs from a sensor group including an entry sensor and a staple home position sensor, to the CPU 51. The driving circuit 54 switches on and off the electromagnetic spring clutch in accordance with a control of the CPU 51, in order to transmit the driving force of a motor to the ejector 20. The driving circuit 54 also drives each solenoid under the control of the CPU 51. The driver 55 drives each motor under the control of the CPU 51.

Figure 11A:
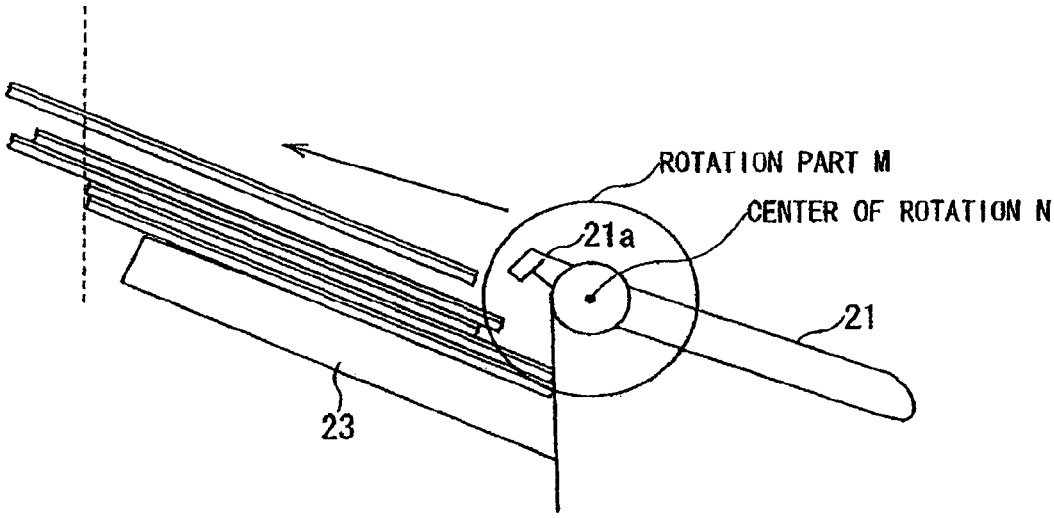
FIG. 11A and FIG. 11B are explanatory views for explaining trouble that can occur if discharging a sheet bundle.
Figure 11B:
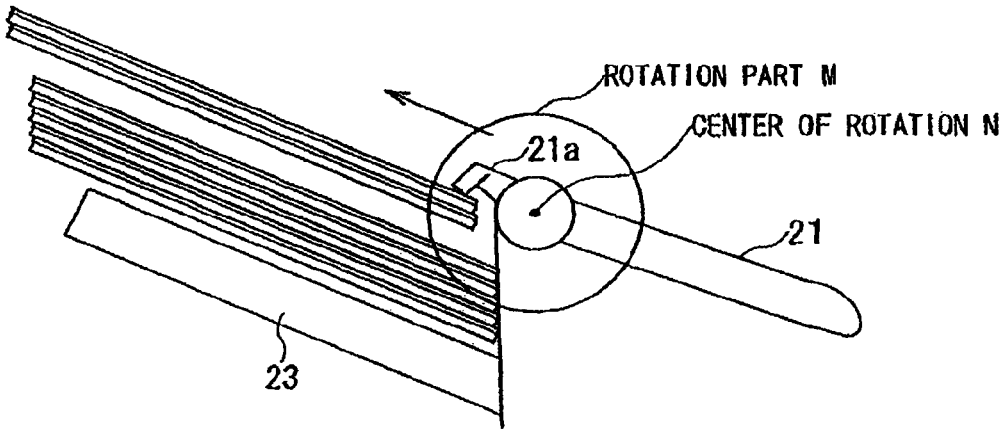

Now, in a configuration in which a sheet bundle is discharged by using the bundle hook 21*a* other than a roller pair, if a stapled sheet bundle has a small number of sheets and the discharge speed of the sheet bundle is much faster than the discharge speed of the sheet bundle used when a sheet bundle is not stapled, the sheet bundle to be discharged to the stack tray (paper discharge tray) 23 is thrown too far as shown in FIG. 11A. Consequently, the sheet bundle stacked on the stack tray 23 has poor alignment. On the other hand, when the stapled sheet bundle has a large number of sheets, the sheets of the sheet bundle to be discharged to the stack tray 23 flex by their own weight. Also, with its large resistance to a sheet bundle that is already stacked on the stack tray 23, the sheet bundle to be stacked onto the stack tray 23 cannot be properly discharged and the bundle hook 21*a* is stuck into the sheet bundle as shown in FIG. 11B. Particularly, the former problem tends to occur for small sheet sizes and the latter tends to occur for large sheet sizes.

Thus, according to this embodiment, the sheet discharge speed after stapling is properly changed in accordance with the number of sheets or the sheet size of the stapled sheet bundle. Specifically, when the bundle hook belt 21 approaches a rotation part M, the driving speed of the bundle hook belt 21 is decelerated to a slow driving speed that is relatively lower than the driving speed of the discharge roller 22. If the stapled sheet bundle has a large number of sheets or a large sheet size, when the bundle hook belt 21 approaches the rotation part M, the driving speed of the bundle hook belt 21 and the driving speed of the discharge roller 22 are set to be higher than the driving speed of the discharge uniformly set in spite of a sheet number or a sheet size in related art. If the stapled sheet bundle has a smaller number of sheets or a small sheet size, when the bundle hook belt 21 approaches the tuning part, the driving speed of the bundle hook belt 21 and the driving speed of the discharge roller 22 are set to be lower than the driving speed of the discharge uniformly set in spite of a sheet number or a sheet size in related art. This enables suitable control of the sheet discharge speed after stapling. Hereinafter, the control of the sheet discharge speed using this technique will be described.

Figure 12:
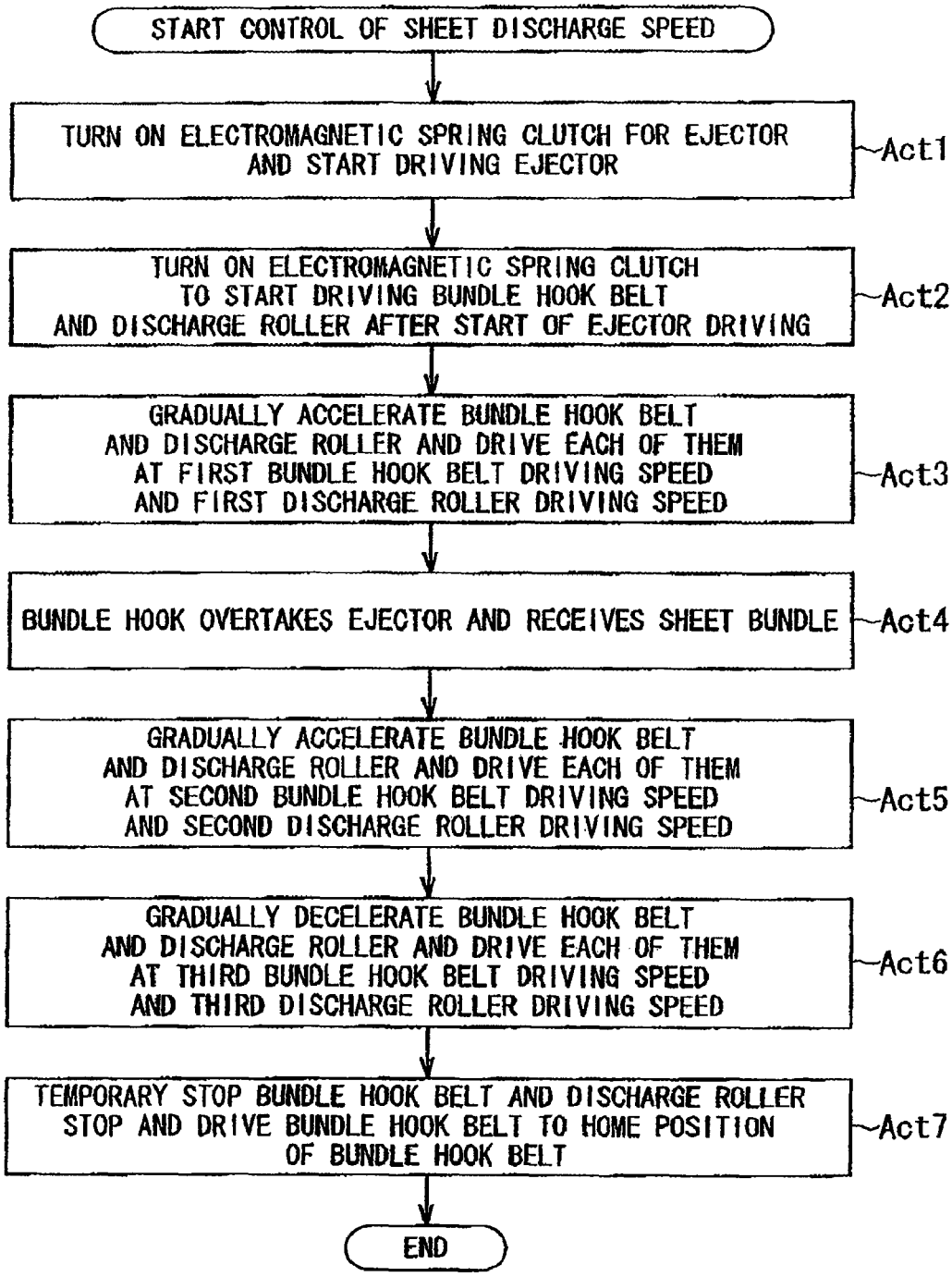
FIG. 12 is a flowchart for explaining control of the sheet discharge speed in the finisher of FIG. 10.
Figure 13:
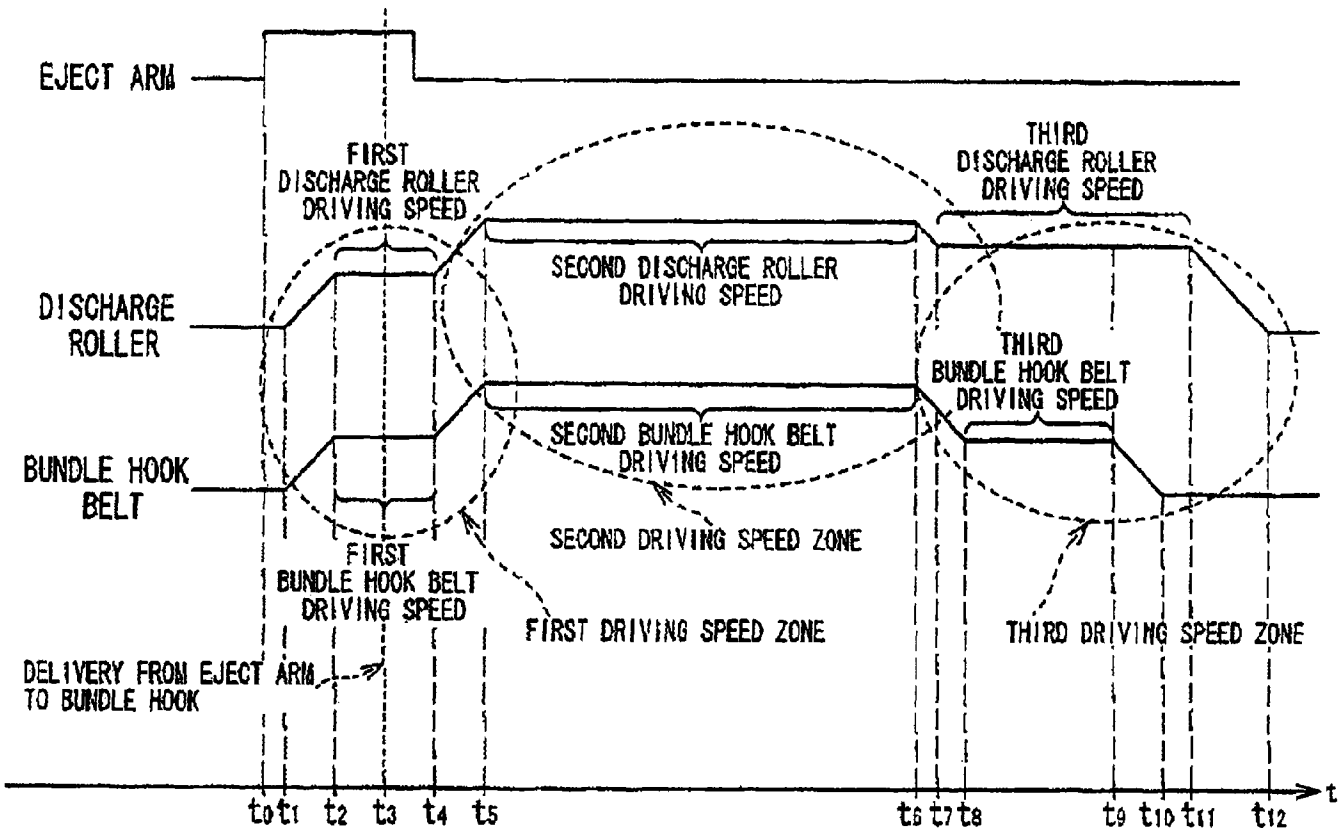
FIG. 13 is a timing chart in executing control of the sheet discharge speed in the finisher.

The control of the sheet discharge speed in the finisher 1 of FIG. 10 will be described with reference to the flowchart of FIG. 12. To simplify the explanation, first, the control of the sheet discharge speed when the stapled sheet bundle has a large number of sheets and a small number of sheets will be described. In explaining the control of the sheet discharge speed of FIG. 12, the timing chart shown in FIG. 13 is properly referred to.

In Act 1, when stapling of the sheet bundle by the stapler 19 is completed, the CPU 51 controls the driving circuit 54 and the driver 55, and turn on the electromagnetic spring clutch at time $t_0$. In Act 2, the CPU 51 controls the driving circuit 54 and the driver 55, and starts to drive the bundle hook motor and the discharge motor at time $t_1$ in a state which the electromagnetic spring clutch is turned on. The drive of the bundle hook belt 21, the discharge roller 22, and the ejector 20 is started. Then, the CPU 51 controls the driver 55 to gradually accelerate the bundle hook belt 21 and the discharge roller 22 during a period from time $t_1$ to time $t_2$. Thus, the driving speed of the bundle hook belt 21 is set to be a first bundle hook belt driving speed, and the driving speed of the discharge roller 22 is set to be a first discharge roller driving speed. In order to synchronize the driving of the bundle hook belt 21 and the discharge roller 22, it is preferable that the first bundle hook belt driving speed and the first discharge roller driving speed are set to be the same.

In Act 3, the CPU 51 controls the driver 55 to respectively drive the bundle hook belt 21 and the discharge roller 22 at the first bundle book belt driving speed and the first discharge roller driving speed during the period from time $t_2$ to time $t_4$. Particularly, the bundle hook belt 21 and the discharge roller 22 are driven at the first bundle book belt driving speed and the first discharge roller driving speed, respectively, at least during the period when the bundle hook belt 21 starts being driven from the home position and is turning as shown in FIG. 9, and on a linear path after its turning (period from time $t_2$ to time $t_3$).

In Act 4, after the bundle hook belt 21 is driven at the first bundle hook belt driving speed under the control of the CPU 51 and reaches the linear path after its turning, the bundle hook 21*a* of the bundle hook belt 21 overtakes the ejector 20 at time $t_3$ and receives the sheet bundle from the ejector 20. In Act 5, the CPU 51 controls the driver 55 to gradually (in stages) accelerate the bundle hook belt 21 and the discharge roller 22 during the period from time $t_4$ to time $t_5$ after the reception of the sheets by the bundle hook belt 21. Thus, the driving speed of the bundle hook belt 21 is set to be a second bundle hook belt driving speed and the driving speed of the discharge roller 22 is set to be a second discharge roller driving speed. To synchronize the driving of the bundle hook belt 21 and the discharge roller 22, it is preferable that the second bundle hook belt driving speed and the second discharge roller driving speed are set to be the same, similarly to the first bundle hook belt driving speed and the first discharge roller driving speed. The second discharge roller driving speed influences the position reached by the sheets on the stack tray 23 after the sheets are discharged.

In Act 5, the CPU 51 controls the driver 55 to drive respectively the bundle hook belt 21 and the discharge roller 22 at the second bundle hook belt driving speed and the second discharge roller driving speed during the period from time $t_5$ to time $t_6$. In Act 6, the CPU 51 controls the driver 55 to gradually (in stages) decelerate the discharge roller 22 during the period from time $t_6$ to time $t_7$, before (predetermined pulses before) the bundle hook belt 21 reaches the rotation part M. Thus, the driving speed of the discharge roller 22 is set to be a third discharge roller driving speed. Meanwhile, the CPU 51 controls the driver 55 to gradually (in stages) decelerate the bundle hook belt 21 during the period from time $t_6$ to time $t_8$, before the bundle hook belt 21 reaches the rotation part M. Thus, the driving speed of the bundle hook belt 21 is set to be a third bundle hook belt driving speed. Now, if the stapled sheet bundle has a large number of sheets, the sheet bundle to be stacked on the stack tray 23 may not be properly discharged and the bundle hook 21*a* may be stuck into the sheet bundle. To prevent this, the third bundle hook belt driving speed is set to be relatively slower than the third discharge roller driving speed.

Then, if the stapled sheet bundle has a large number of sheets, the third bundle hook belt driving speed of the bundle hook belt 21 and the third discharge roller driving speed of the discharge roller 22 in a third driving speed zone are set to be higher than the third bundle hook belt driving speed and the third discharge roller driving belt, respectively, when the stapled sheet bundle has a small number of sheets. That is, if the stapled sheet bundle has a large number of sheets, the third bundle hook belt driving speed of the bundle hook belt 21 is set to be a "high third bundle hook belt driving speed" and the third discharge roller driving speed of the discharge roller 22 is set to be a "high third discharge roller driving speed". On the other hand, if the stapled sheet bundle has a small number of sheets, the third bundle hook belt driving speed of the bundle hook belt 21 is set to be a "low third bundle hook belt driving speed" and the third discharge roller driving speed of the discharge roller 22 is set to be a "low third discharge roller driving speed".

Thus, when the stapled sheet bundle has a large number of sheets, the situation can be prevented that the sheet bundle to be stacked on the stack tray 23 cannot be properly discharged and the bundle hook 21*a* is stuck into the sheet bundle because of flexure of the sheets of the sheet bundle to be discharged to the stack tray 23 by their own weight and also because of the large resistance to a sheet bundle that is already stacked on the stack tray 23. Also, when the stapled sheet bundle has a small number of sheets, the sheet bundle to be discharged to the stack tray 23 can be prevented from being thrown too far, and alignment of the sheet bundle stacked on the stack tray 23 can be improved. Therefore, the discharge speed of sheets after stapling can be suitably controlled in accordance with the number of sheets of the stapled sheet bundle.

When the stapled sheet bundle has a large number of sheets, even if the third bundle hook belt driving speed and the third discharge roller driving speed are high, the sheet bundle moves even on the stack tray 23 because of its own weight. Therefore, it is possible to maintain alignment of the sheet bundle.

After that, the CPU 51 controls the driver 55 to drive the bundle hook belt 21 at the third bundle hook belt driving speed during the period from time $t_8$ to time $t_9$. The CPU 51 also controls the driver 55 to drive the discharge roller 22 at the third discharge roller driving speed during the period from time $t_7$ to time $t_{11}$. Then, the CPU 51 controls the driver 55 to gradually decelerate the bundle hook belt 21 during the period from time $t_9$ to time $t_{10}$, so that the driving speed of the bundle hook belt 21 reaches almost zero. Meanwhile, the CPU 51 controls the driver 55 to gradually decelerate the discharge roller 22 in different timing from the bundle hook belt 21 during the period from time $t_{11}$ to time $t_{12}$, so that the driving speed of the discharge roller 22 reaches almost zero.

The sheet bundle is eventually discharged to the stack tray 23 by the discharge roller 22. Thus, when the stapled sheet bundle has a large number of sheets, the bundle hook 21*a* can be prevented from being stuck in the sheet bundle, whereas when the stapled sheet bundle has a small number of sheets, the bundle hook 21*a* can be prevented from being stuck in the sheet bundle even if the third bundle hook belt driving speed is set to the "low third bundle hook belt driving speed".

In Act 7, the CPU 51 controls the driving circuit 54 and drives the bundle hook belt 21 to a home position of the bundle hook belt 21 after the sheet bundle is discharged.

Sticking of the bundle hook 21*a* into the sheet bundle when the stapled sheet bundle has a large number of sheets tends to occur for small-sized sheets. On the other hand, poor alignment of the sheet bundle stacked on the stack tray 23 when the stapled sheet bundle has a small number of sheets tends to occur for large-sized sheets. Thus, when the stapled sheets have a large size (for example, B4 or A3 size), the third bundle hook belt driving speed of the bundle hook belt 21 may be set to the "high third bundle hook belt driving speed" and the third discharge roller driving speed of the discharge roller 22 may be set to the "high third discharge roller driving speed". Meanwhile, when the stapled sheet bundle has small-sized sheets (for example, A5 or B5 size), the third bundle hook belt driving speed of the bundle hook belt 21 may be set to the "low third bundle hook belt driving speed" and the third discharge roller driving speed of the discharge roller 22 may be set to the "low third discharge roller driving speed".

The driving speed may be set in accordance with a combination of the number of sheets and sheet size. That is, as shown in the correspondence table of FIG. 14, if the stapled sheet bundle has a large number of sheets and has large-sized sheets, the third bundle hook belt driving speed of the bundle hook belt 21 may be set to the "high third bundle hook belt driving speed" and the third discharge roller driving speed of the discharge roller 22 may be set to the "high third discharge roller driving speed". If the stapled sheet bundle has a small number of sheets and has small-sized sheets, the third bundle hook belt driving speed of the bundle hook belt 21 may be set to the "ultra-low third bundle hook belt driving speed" and the third discharge roller driving speed of the discharge roller 22 may be set to the "ultra-low third discharge roller driving speed". The setting of the driving speed is not limited to such cases. The number of sheets and sheet size may be classified in a stepwise and detailed manner. Thus, the third bundle hook belt driving speed and the third discharge roller driving speed may be set in a detailed manner.

Second Embodiment

A second embodiment of the invention will be described now. The configuration of the second embodiment is similar to the configuration of the first embodiment shown in FIGS. 1 to 10 and the repeated description thereof is omitted. As long as it is not particularly described, it is assumed that the maximum number of sheets that can be stacked on the standby tray 13 is three.

Figure 15:
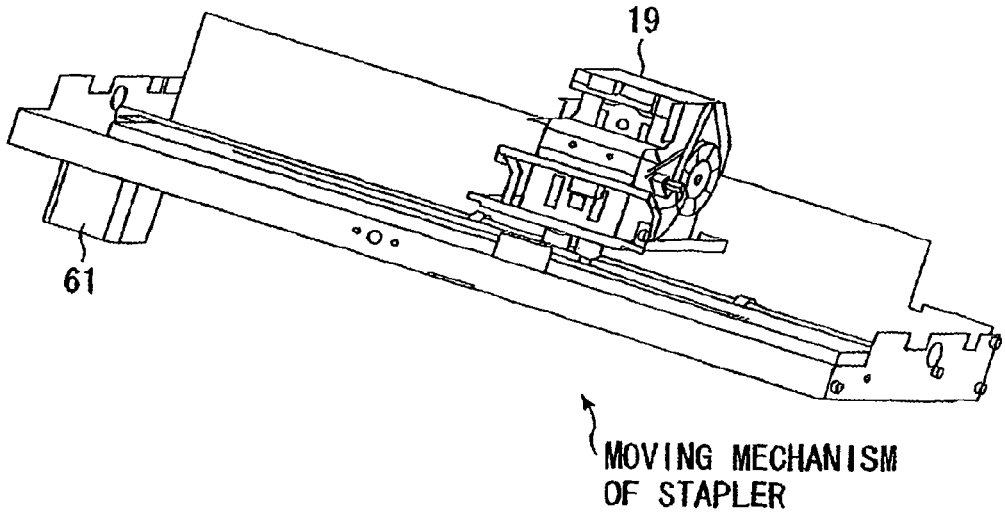
FIG. 15 is a perspective view of a moving mechanism of a stapler.
Figure 16:
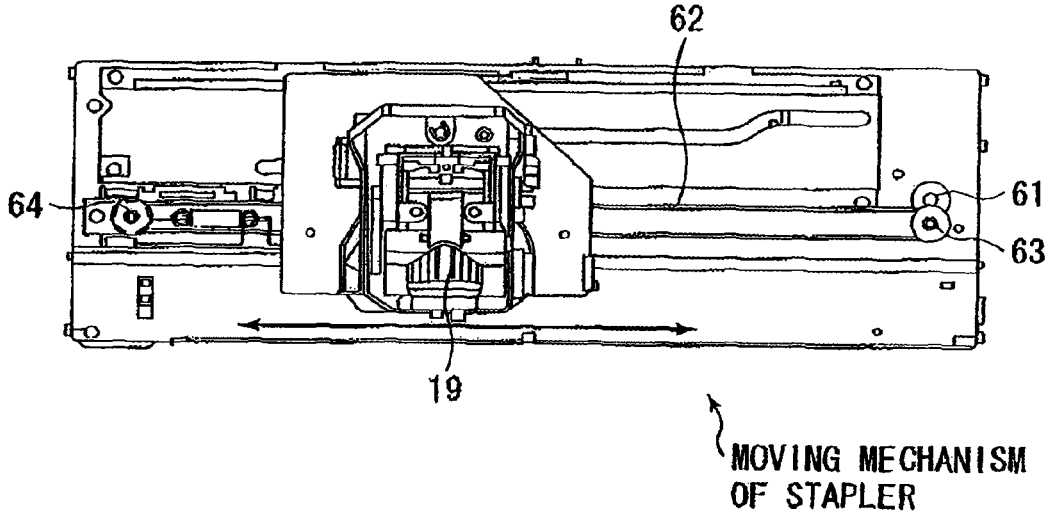
FIG. 16 is a plan view of the moving mechanism of the stapler.

FIGS. 15 and 16 show a configuration of a moving mechanism of the stapler 19. FIG. 15 is a perspective view of the moving mechanism of the stapler 19 and FIG. 16 is a plan view of the moving mechanism of the stapler 19. As shown in FIGS. 15 and 16, the moving mechanism of the stapler 19 has a stapler shift motor 61, which is stepping motor, as a driving source. The moving mechanism of the stapler 19 includes a timing belt 62, a driving pulley 63, and a driven pulley 64, in addition to the stapler shift motor 61. The rotational driving of the stapler shift motor 61 is transmitted to the driving pulley 63 and then is transmitted to the timing belt 62 extending between the driving pulley 63 and the driving pulley 64. The stapler shift motor 61 is fixed and connected to the timing belt 62 and moves in the direction of the arrow shown in FIG. 16 with the rotation of the timing belt 62.

When the post-processing is performed by the finisher 1, the time taken for performing the post-processing is added. Accordingly, compared with the case where the sheets P having images formed by an image forming unit is not subjected to any post-processing and the sheets are discharged and stacked, the time for processing the sheets P increases. Therefore, conventionally, when much time is taken for the post-processing, a request for adding the standby time is given to the image forming unit. In response to the standby time adding request from the finisher 1, the image forming unit is controlled to change the standby time until an image is formed on a subsequent sheet P. In this embodiment, the standby time is defined as a "delay time."

To solve the above-mentioned problem, a mechanism for temporarily buffering (holding) two or three sheets P carried from the image forming unit (for example, standby tray 13) is disposed in the finisher 1. However, when three sheets P are buffered by the standby tray 13 but the number of sheets in the sheet bundle to be stapled is two, two sheets are stapled and thus the sheet bundle having only two sheets should be buffered. Accordingly, even when the standby tray 13 is disposed in the finisher 1, the delay time is still required. When an instruction to staple a sheet bundle at two positions is given, a shift process of shifting the stapler 19 by the use of the stapler shift motor 61 is necessary and thus the post-processing time is elongated. Therefore, even when the number of sheets in the sheet bundle stapled is three, the delay time is still required.

However, in JP-A-4-148993, there is no problem when the processing is continued with the same sheet gap, but an extra delay time (standby time) is added when a mode with a long sheet gap is switched to a mode with a short sheet gap, thereby deteriorating the performance of the image forming process. For example, when the two-position stapling is continued, there is no problem. However, when the two-position stapling is switched to the one-position stapling, the delay time for the two-position stapling is taken, thereby adding the extra standby time.

Therefore, in this embodiment, to solve the above-mentioned problem, it is assumed that the delay time between the sheet bundle having images previously formed thereon and being stapled and the sheet bundle having images subsequently formed thereon and being stapled is not changed to be longer, but the delay time between the sheet P prior by one sheet to the final sheet in the sheet bundle to be stapled by the stapler 19 and the final sheet P is changed to be longer.

Figure 17A:
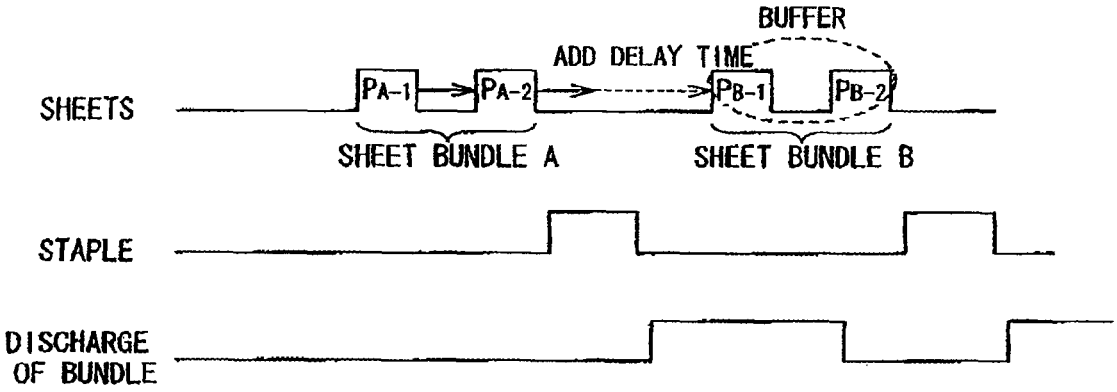
FIG. 17A is a timing diagram illustrating a state where a delay time is conventionally changed when the number of sheets in the sheet bundle stapled by the stapler is two and FIG. 17B is a timing diagram illustrating a state where a delay time in the embodiment is changed when the number of sheets in the sheet bundle stapled by the stapler is two.

That is, conventionally, as shown in FIG. 17A, for example, when the number of sheets in the sheet bundle stapled is two, the delay time between the sheet bundle A (sheet bundle including sheet $P_{A\text{-}1}$ and sheet $P_{A\text{-}2}$) having images previously formed thereon and being stapled and the sheet bundle B (sheet bundle including sheet $P_{B\text{-}1}$ and sheet $P_{B\text{-}2}$) having images subsequently formed thereon and being stapled is changed to be longer. In other words, the delay time is changed for the first sheet $P_{B\text{-}1}$ in the sheet bundle B having images subsequently formed thereon and being stapled.

Figure 17B:
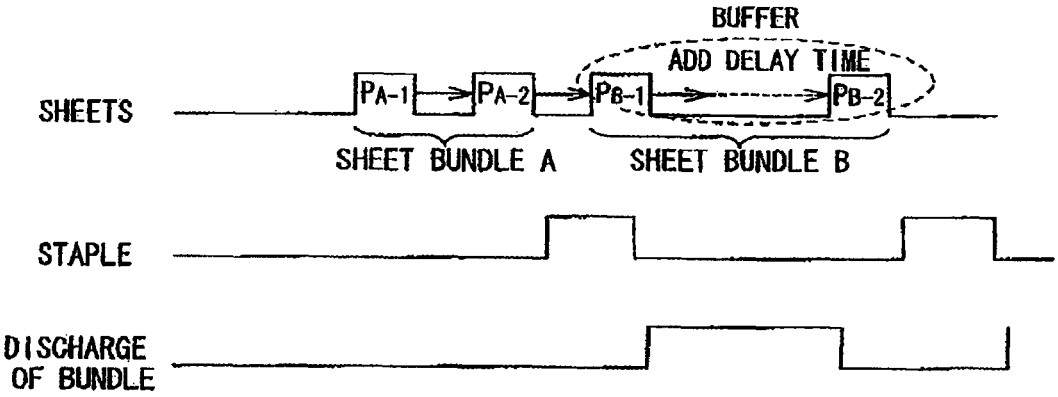
Figure 18A:
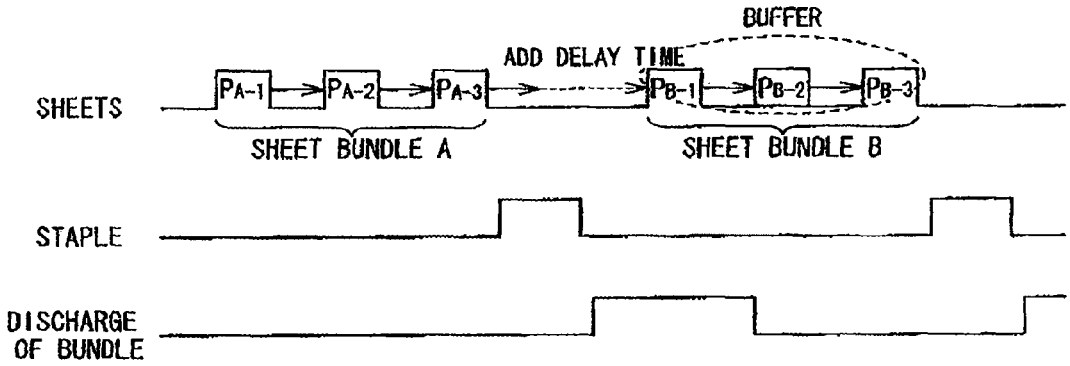
FIG. 18A is a timing diagram illustrating a state where the delay time is conventionally changed when the number of sheets in the sheet bundle stapled by the stapler is three and FIG. 18B is a timing diagram illustrating a state where the delay time in the embodiment is changed when the number of sheets in the sheet bundle stapled by the stapler is three.
Figure 18B:
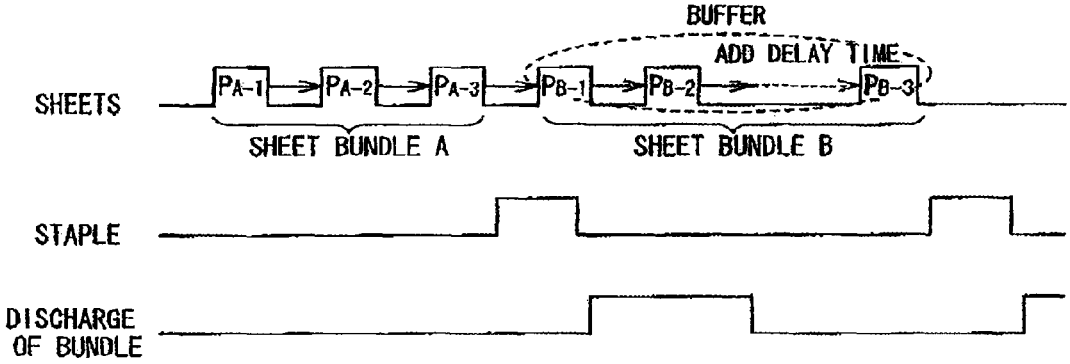

On the contrary, in this embodiment, as shown in FIG. 17B, the delay time between the sheet $P_{B\text{-}1}$ prior by one sheet to the final sheet in the sheet bundle B to be stapled by the stapler 19 and the final sheet $P_{B\text{-}2}$ is changed to be longer. In other words, the delay time is changed for the final sheet $P_{B\text{-}2}$ in the sheet bundle B having images subsequently formed thereon and being stapled. When the final sheets $P_{B\text{-}2}$ in the sheet bundle B is carried from the exit rollers 12*a* and 12*b*, the image forming unit outputs a stapling instruction signal for the stapler 19 to the CPU 51 of a control unit. At this time, the sheet bundle B including the sheet $P_{B\text{-}1}$ and the sheet $P_{B\text{-}2}$ is held by the standby tray 13 until the discharge of the sheet bundle is completed. FIGS. 18A and 18B are timing diagrams illustrating states of the related art and of the embodiment where the delay time is changed when the number of sheets in the sheet bundle to be stapled is three. In this embodiment, as shown in FIG. 18B, the delay time between the sheet $P_{B\text{-}2}$ prior by one sheet to the final sheet of the sheet bundle B to be stapled by the stapler 19 and the final sheet $P_{B\text{-}3}$ is changed to be longer.

Figure 19:
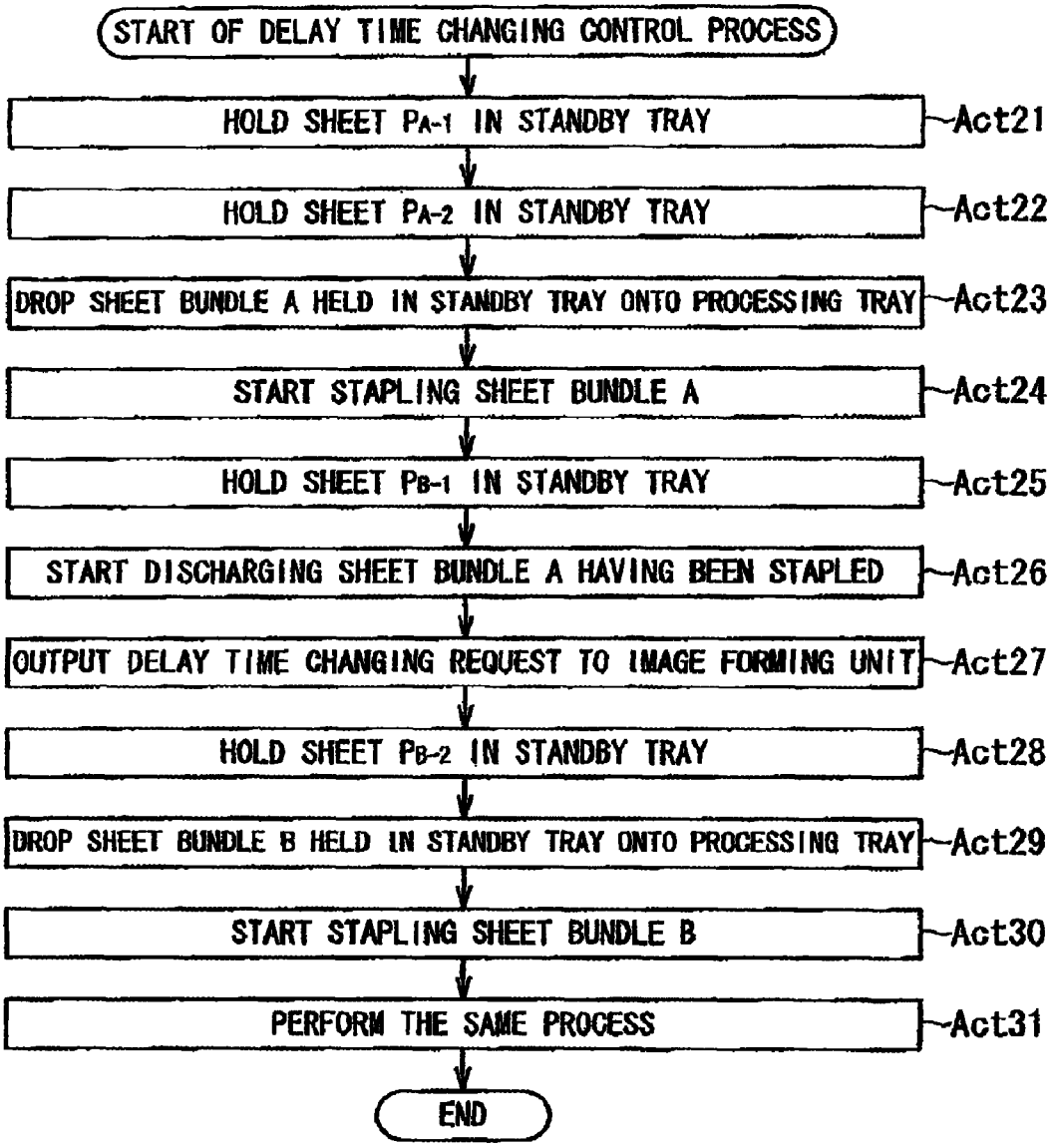
FIG. 19 is a flowchart illustrating a delay time changing control process in the finisher shown in FIG. 10 when the number of sheets in the sheet bundle stapled by the stapler is two.

A delay time changing control process in the finisher 1 shown in FIG. 10 when the number of sheets in the sheet bundle to be stapled is two will be described with reference to FIG. 19. In FIG. 19, t is assumed that the number of sheets in the sheet bundle to be stapled is two and the timing diagram shown in FIG. 17B is properly referred to at the time of describing the delay time changing control process shown in FIG. 19.

In Act 21, the standby tray 13 temporarily holds the sheet $P_{A\text{-}1}$ carried from the exit rollers 12*a* and 12*b*. In Act 22, the standby tray 13 temporarily holds the sheet $P_{A\text{-}2}$ carried from the exit rollers 12*a* and 12*b* subsequently to the sheet $P_{A\text{-}1}$. At this time, the image forming unit outputs the stapling instruction signal on the sheet bundle A to the CPU 51. In Act 23, the finisher 1 opens the standby tray 13 and drops and supplies the temporarily-held sheets $P_{A\text{-}1}$ and $P_{A\text{-}2}$ to the processing tray 14. The sheet guide 18 guides the trailing ends of the sheets $P_{A\text{-}1}$ and $P_{A\text{-}2}$ supplied to the processing tray 14 to the stapler 19.

In Act 24, the CPU 51 of the control unit controls the driver 55 to drive the stapler motor in accordance with the stapling instruction signal on the sheet bundle A from the image forming unit, thereby starting the stapling of the sheet bundle A (sheet bundle including the sheets $P_{A\text{-}1}$ and $P_{A\text{-}2}$) by the use of the stapler 19. In Act 25, the standby tray 13 temporarily holds the sheet $P_{B\text{-}1}$ carried from the exit rollers 12*a* and 12*b* during the stapling. In Act 26, the CPU 51 controls the driver 55 to drive the bundle hook motor, thereby starting the discharging of the sheet bundle A having been stapled. In Act 27, the CPU 51 outputs a delay time changing request (delay time changing instruction) to the external image forming unit to change the delay time between the sheet $P_{B\text{-}1}$ prior by one sheet to the final sheet in the sheet bundle B to be stapled by the stapler 19 and the final sheet $P_{B\text{-}2}$ to be longer, in order to prevent the sheet $P_{B\text{-}2}$ from being carried to the standby tray 13 until the discharging of the sheet bundle A is completed after the sheet bundle A stapled in Act 26 is discharged. The image forming unit changes the delay time between the sheet $P_{B\text{-}1}$ prior by one sheet to the final sheet in the sheet bundle B to be stapled and the final sheet $P_{B\text{-}2}$ to be longer in accordance with the delay time changing request from the finisher 1. Accordingly, the delay time between the sheet $P_{B\text{-}1}$ prior by one sheet to the final sheet and the final sheet $P_{B\text{-}2}$ is changed to be longer than the delay time added between the sheet $P_{A\text{-}1}$ and the sheet $P_{A\text{-}2}$ (the delay time indicated by the one-dot chained line in FIG. 17B is added).

In Act 28, the standby tray 13 temporarily holds the sheet $P_{B\text{-}2}$ carried from the exit rollers 12*a* and 12*b* subsequently to the sheet $P_{B\text{-}1}$. At this time, the image forming unit outputs the stapling instruction signal on the sheet bundle B for the stapler 19 to the CPU 51 of the control unit. In Act 29, the finisher 1 opens the standby tray 13 and drops and supplies the temporarily-held sheets $P_{B\text{-}1}$ and $P_{B\text{-}2}$ to the processing tray 14. The sheet guide 18 guides the trailing ends of the sheets $P_{B\text{-}1}$ and $P_{B\text{-}2}$ supplied to the processing tray 14 to the stapler 19. In Act 30, the CPU 51 of the control unit controls the driver 55 to drive the stapler motor in accordance with the stapling instruction signal on the sheet bundle B from the image forming unit, thereby starting the stapling of the sheet bundle B (sheet bundle including the sheets $P_{B\text{-}1}$ and $P_{B\text{-}2}$). Thereafter, the same process as described hitherto is performed in Act 31.

On the premise of the above-mentioned delay time changing control process, a variety of delay time changing control processes according to this embodiment will be described.

Figure 20A:
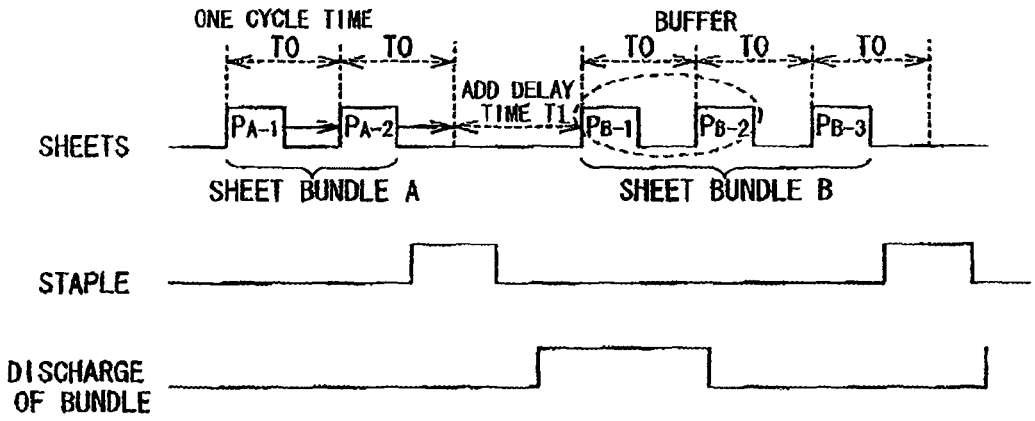
FIG. 20A is a timing diagram illustrating a state where the delay time is conventionally changed when the number of sheets in the sheet bundle stapled by the stapler is switched from two to three and FIG. 20B is a timing diagram illustrating a state where the delay time in the embodiment is changed when the number of sheets in the sheet bundle stapled by the stapler is switched from two to three.

As described above, in JP-A-4-148993, there is no problem when the processing is continued with the same sheet gap, but an extra delay time (standby time) is added when a mode with a long sheet gap is switched to a mode with a short sheet gap, thereby deteriorating the performance of the image forming process. FIG. 20A is a timing diagram illustrating a state where the delay time is conventionally changed when the case (two-sheet stapling) where the number of sheets in the sheet bundle to be stapled is two is switched to the case (three-sheet stapling) where the number of sheets in the sheet bundle to be stapled is three. As shown in FIG. 20A, conventionally, the delay time between a sheet bundle A (sheet bundle including sheets $P_{A-1}$ and $P_{A-2}$) having images previously formed thereon and being stapled and a sheet bundle B (sheet bundle including sheets $P_{B-1}$, $P_{B-2}$, and $P_{B-3}$) having images subsequently formed thereon and being stapled is changed to be longer. Accordingly, when the time for an image forming cycle of one sheet P1 is T0, the time for guiding the sheet bundle B to the processing tray 14 after the sheet bundle A is stapled and discharged is about T0×5+T1.

Figure 20B:
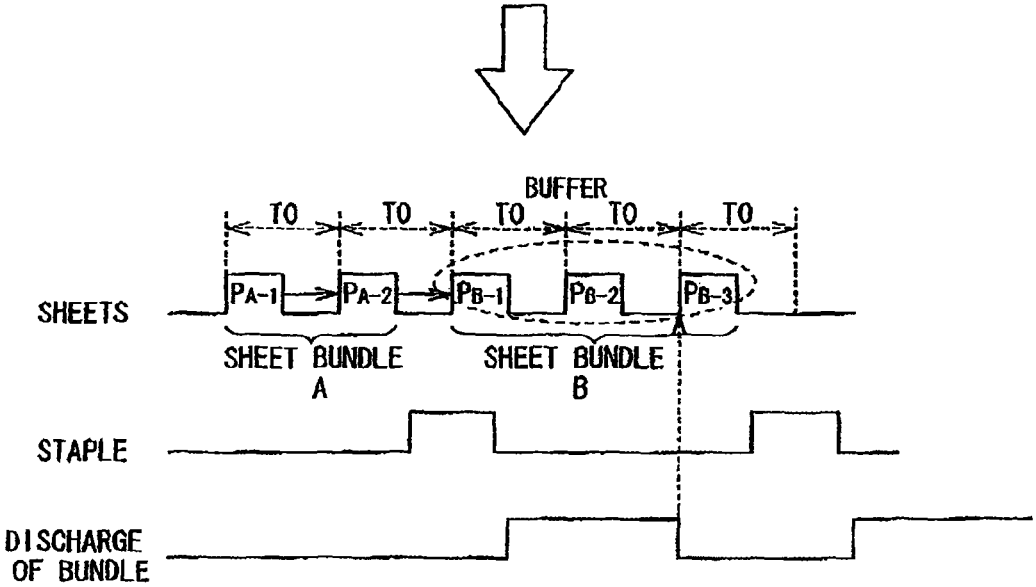
Figure 21:
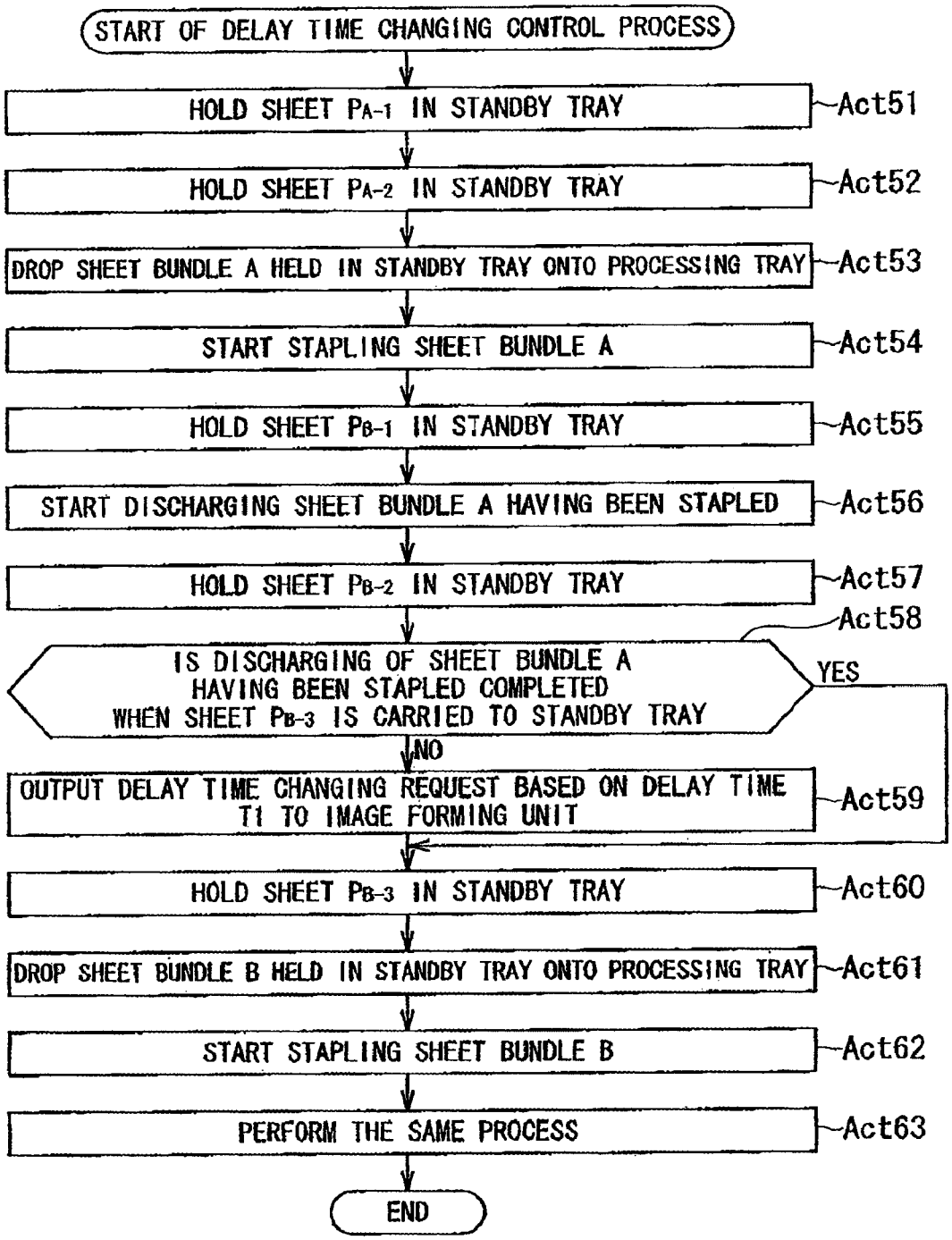
FIG. 21 is a flowchart illustrating a delay time changing control process in the finisher shown in FIG. 10 when the mode with a long sheet gap is changed to the mode with a short sheet gap.

On the contrary, in this embodiment, the delay time between the sheet P prior by one sheet to the final sheet in the sheet bundle B to be stapled by the stapler 19 and the final sheet P is changed to be longer in principle. However, as shown in FIG. 20B, even when the sheet bundle A having been stapled is discharged, the discharging of the sheet bundle A is completed when the sheet $P_{B-3}$ is carried to the standby tray 13. Accordingly, it can be determined that it is not necessary to change the delay time between the sheet $P_{B-1}$ prior by one sheet to the final sheet in the sheet bundle B to be stapled by the stapler 19 and the final sheet $P_{B-2}$ to be longer. Therefore, since it is not necessary to add the delay time T1, the time necessary for additionally guiding the sheet bundle B to the processing tray 14 after the sheet bundle A is stapled and discharged is only about T0×5, thereby saving the delay time T1. This delay time changing control process is shown in FIG. 21.

The delay time changing control process in the finisher 1 shown in FIG. 10 when the mode with a long sheet gap is changed to the mode with a short sheet gap will be described with reference to the flowchart shown in FIG. 21. In FIG. 21, it is assumed that the case where the number of sheets in the sheet bundle stapled is two is changed to the case where the number of sheets in the sheet bundle stapled is three. The timing diagram shown in FIG. 20B is referred to at the time of describing the delay time changing control process shown in FIG. 21. The processes of Acts 51 to 56 and the processes of Acts 61 to 63 shown in FIG. 21 are basically similar to the processes of Acts 21 to 26 and Acts 29 to 31 shown in FIG. 19 and the repeated description thereof is omitted.

In Act 57, the standby tray 13 temporarily holds the sheet $P_{B-2}$ carried from the exit rollers 12*a* and 12*b*, subsequently to the sheet $P_{B-1}$. The sheet $P_{B-2}$ is the second sheet P in the sheet bundle B including three sheets. In Act 58, the CPU 51 determines whether the discharging of the stapled sheet bundle A is completed when the sheet $P_{B-3}$ is carried to the standby tray 13. When the CPU 51 determines in Act 58 that the discharging of the stapled sheet bundle A is not completed when the sheet $P_{B-3}$ is carried to the standby tray 13, the CPU 51, in Act 59, outputs a delay time changing request (delay time changing instruction) to the external image forming unit to change the delay time between the sheet $P_{B-2}$ prior by one sheet to the final sheet in the sheet bundle B to be stapled by the stapler 19 and the final sheet $P_{B-3}$ to be longer, in order to prevent the sheet $P_{B-3}$ from being carried to the standby tray 13 until the discharging of the sheet bundle A is completed after the sheet bundle A stapled in Act 56 is discharged.

When the CPU 51 determines in Act 58 that the discharging of the stapled sheet bundle A is completed when the sheet $P_{B-3}$ is carried to the standby tray 13, the process of Act 59 is skipped. In Act 60, the standby tray 13 temporarily holds the sheet $P_{B-3}$ carried from the exit rollers 12*a* and 12*b*, subsequently to the sheet $P_{B-2}$. Thereafter, the process of Act 61 and the processes subsequent to Act 61 are performed.

Accordingly, when it is determined that the discharging of the stapled sheet bundle A is completed when the sheet $P_{B-3}$ is carried to the standby tray 13, it is not necessary to add the delay time T1. Accordingly, the time until the sheet bundle B is guided to the processing tray 14 after the sheet bundle A is stapled and discharged is only about T0×5, thereby saving the delay time T1.

Figure 22A:
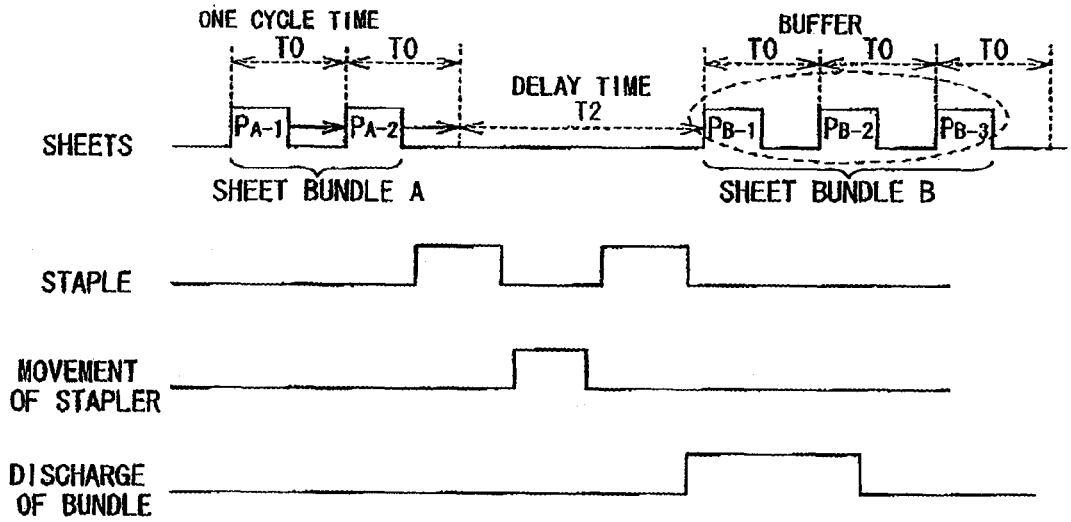
FIG. 22A is a timing diagram illustrating a state where the delay time is conventionally changed when stapling two sheets at two positions is switched to stapling three sheets at two positions and FIG. 22B is a timing diagram illustrating a state where the delay time in the embodiment is changed when stapling two sheets at two positions is switched to stapling three sheets at two positions.

As described above, for example, there is no problem when the two-position stapling is continued, but the delay time for stapling two sheets at two positions is taken when the process of stapling two sheets at two positions is switched to the process of stapling three sheets at one position, thereby adding the extra standby time. FIG. 22A is a timing diagram illustrating a state where the delay time is conventionally changed when the process of stapling two sheets at two positions is switched to the process of stapling three sheets at one position. As shown in FIG. 22A, conventionally, the delay time T2 (T2>T1) greater than the delay time T1 used for the process of stapling two sheets at one position is required to perform the process of stapling two sheets at two positions on time.

Figure 22B:
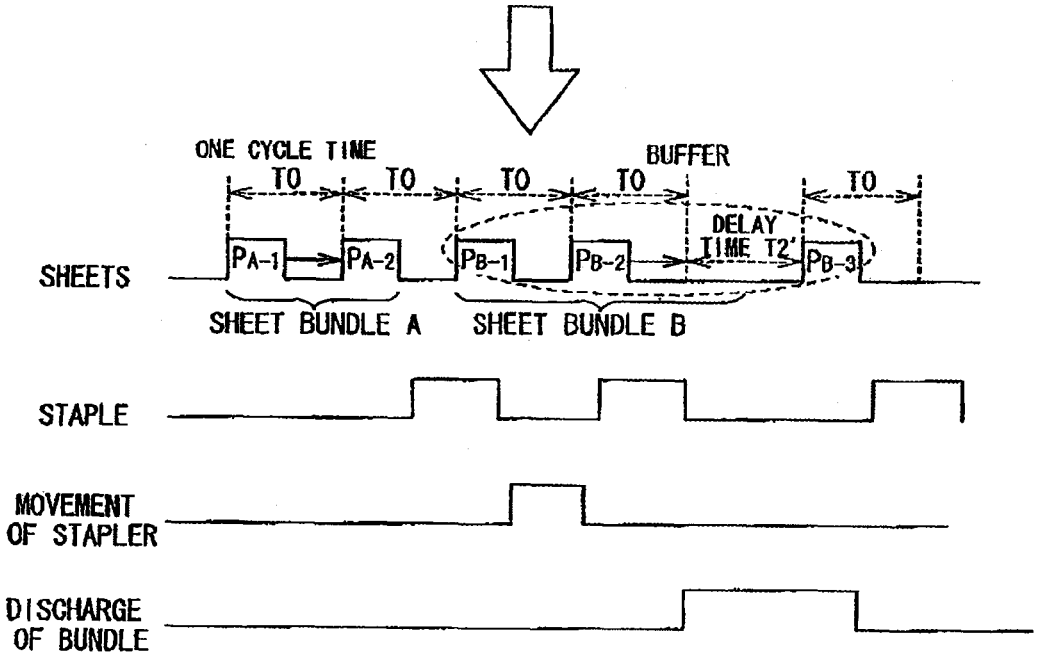
Figure 23:
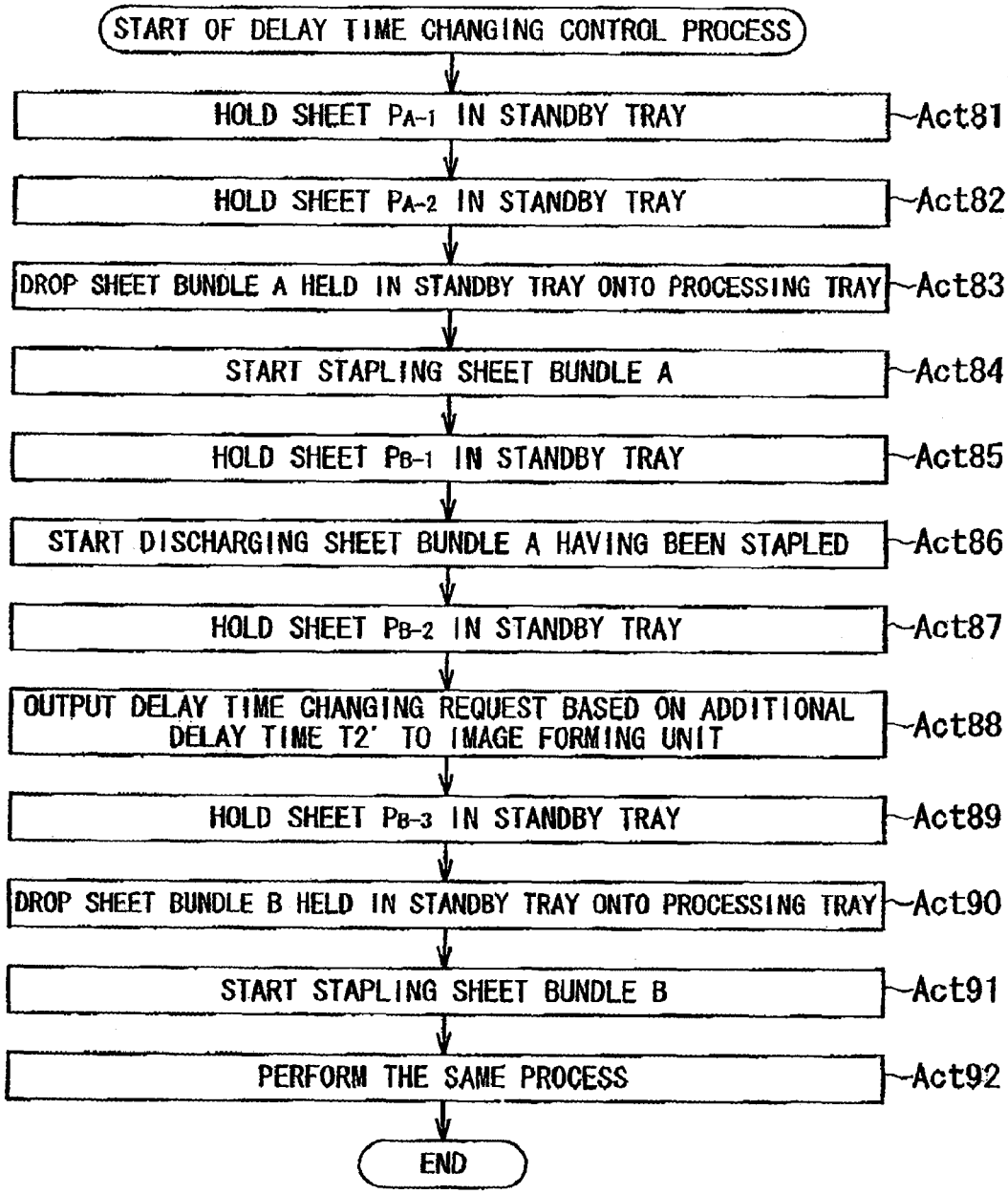
FIG. 23 is a flowchart illustrating the delay time changing control process in the finisher shown in FIG. 10 when stapling two sheets at two positions is switched to stapling three sheets at two positions.

On the contrary, in this embodiment, the delay time between the sheet P prior by one sheet to the final sheet in the sheet bundle B to be stapled and the final sheet P is changed to be longer in principle. As shown in FIG. 22B, by using the optimized delay time T2' (=T2−T0) instead of the delay time T2, the discharging of the sheet bundle A is completed when the sheet $P_{B-3}$ is carried to the standby tray 13, even when the two-position stapling is performed. Accordingly, it is not necessary to utilize the delay time T2 so as to perform the two-position stapling on time. The reason for deriving the delay time T2' from the expression of T2−T0 is that the time for the image forming cycle of the sheet P1 can be saved by carrying the sheet $P_{B-1}$ to the standby tray 13 without adding the delay time after the stapling of the sheet bundle A. The delay time changing control process in this case is shown in FIG. 23.

The delay time changing control process in the finisher 1 shown in FIG. 10 when the process of stapling two sheets at two positions is changed to the process of stapling three sheets at two positions will be described with reference to the flowchart shown in FIG. 23. The timing diagram shown in FIG. 22B is properly referred to at the time of describing the delay time changing control process shown in FIG. 23. The processes shown in FIG. 23 are basically similar to the processes shown in FIG. 19 and the repeated description thereof is omitted. In the stapling of Act 84 or 91, the stapler shift motor 61 is driven to allow the stapler 19 to move as needed.

In Act 88, the CPU 51 outputs a delay time changing request (delay time changing instruction) based on the delay time T2' to the external image forming unit to change the delay time between the sheet $P_{B-2}$ prior by one sheet to the final sheet in the sheet bundle B to be stapled and the final sheet $P_{B-3}$ to be longer, in order to prevent the sheet $P_{g-3}$ from being carried to the standby tray 13 until the discharging of the sheet bundle A stapled at two positions is completed after the sheet bundle A stapled in Act 86 is discharged. The image forming unit changes the delay time between the sheet $P_{B-2}$ prior by one sheet to the final sheet in the sheet bundle B to be stapled by the stapler 19 and the final sheet $P_{g-3}$ to be longer in accordance with the delay time changing request based on the delay time T2' from the finisher 1. Accordingly, the delay time between the sheet $P_{B-2}$ prior by one sheet to the final sheet and the final sheet $P_{g-3}$ is changed to be longer than the delay time between the sheet $P_{A-1}$ and the sheet $P_{A-2}$ or between the sheet $P_{B-1}$ and the sheet $P_{B-2}$ (the delay time T2' indicated by the one-dot chained line in FIG. 22B is added).

Accordingly, when the process of stapling two sheets at two positions is switched to the process of stapling three sheets at two positions, it is possible to prevent the delay time T2 for the process of stapling two sheets at two positions from being taken.

Although it has been assumed above that the maximum number of sheets stacked on the standby tray 13 is three, this embodiment is not limited to the case. The maximum number of sheets stacked on the standby tray 13 may be four or five. The delay time changing control process when the maximum number of sheets stacked on the standby tray 13 is five or more and the process of stapling two sheets at two positions is switched to the process of stapling five sheets at two positions will be described now.

Figure 24A:
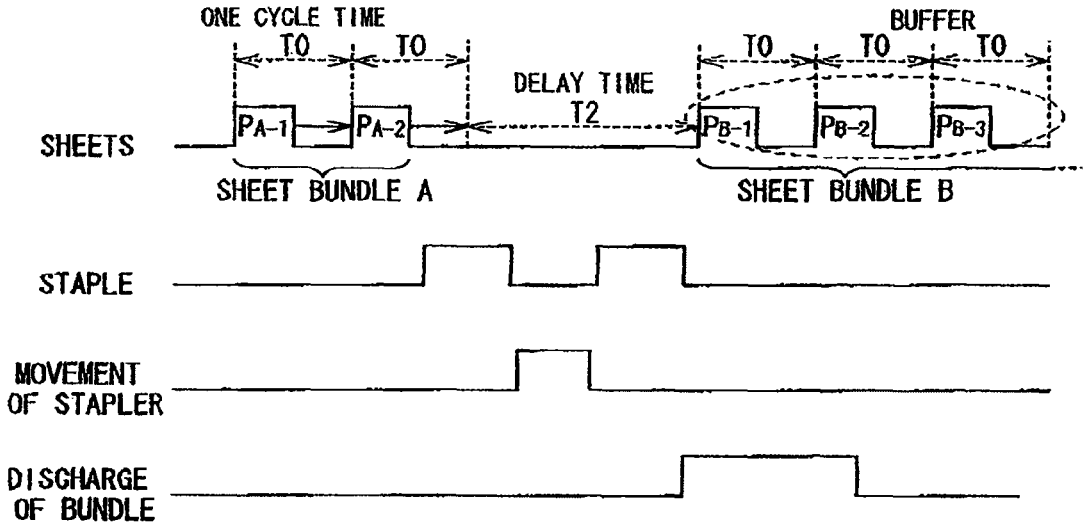
FIG. 24A is a timing diagram illustrating a state where the delay time is conventionally changed when stapling two sheets at two positions is switched to stapling five sheets at two positions and FIG. 24B is a timing diagram illustrating a state where the delay time in the embodiment is changed when stapling two sheets at two positions is switched to stapling five sheets at two positions.
Figure 24B:
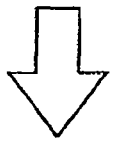
Figure 24B:
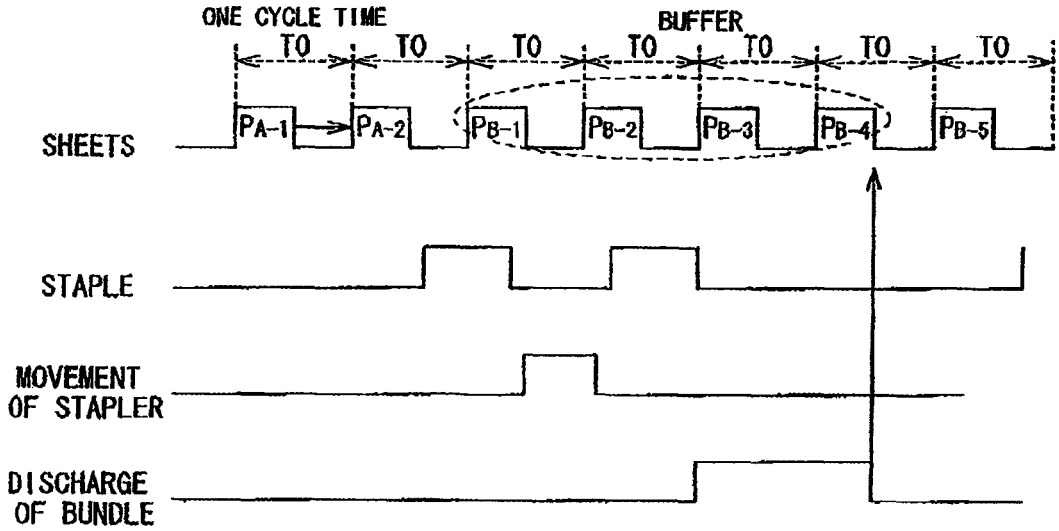

FIG. 24A is a timing diagram illustrating a state where the delay time is conventionally changed when the process of stapling two sheets at two positions is switched to the process of stapling five sheets at two positions. As shown in FIG. 24A, conventionally, the delay time T2 (T2>T1) greater than the delay time T1 used for the process of stapling two sheets at one position is required to perform the process of stapling two sheets at two positions on time.

Figure 25:
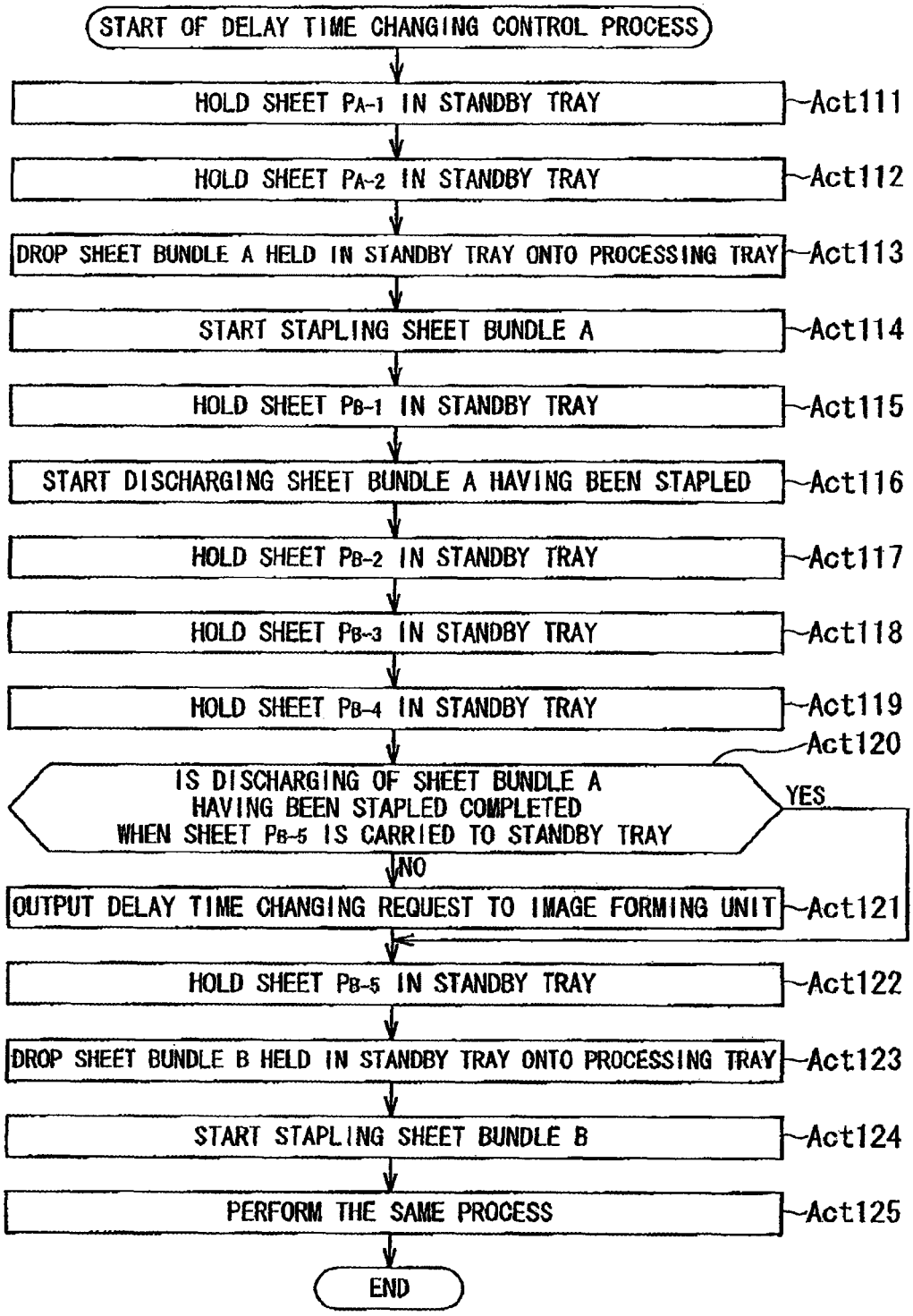
FIG. 25 is a flowchart illustrating the delay time changing control process in the finisher shown in FIG. 10 when stapling two sheets at two positions is switched to stapling five sheets at two positions.

On the contrary, in this embodiment, the delay time between the sheet P prior by one sheet to the final sheet in the sheet bundle B to be stapled and the final sheet P is changed to be longer in principle. However, even when the stapled sheet bundle A is discharged, the discharging of the sheet bundle A is completed when the sheet $P_{B-5}$ is carried to the standby tray 13. Accordingly, it can be determined that it is not necessary to change the delay time between the sheet $P_{B-4}$ prior by one sheet to the final sheet in the sheet bundle to be stapled and the final sheet $P_{B-5}$. Therefore, since the delay time need not be added, the time until the sheet bundle B is guided to the processing tray 14 after the sheet bundle A is stapled and discharged is only about T0×7, thereby saving the delay time. The delay time changing control process in this case is shown in FIG. 25.

The delay time changing control process in the finisher 1 shown in FIG. 10 when the process of stapling two sheets at two positions is changed to the process of stapling five sheets at two positions will be described with reference to the flowchart shown in FIG. 25. The processes shown in FIG. 25 are basically similar to the processes shown in FIG. 21 and the repeated description thereof is omitted.

In Act 120, the CPU 51 determines whether the discharging the stapled sheet bundle A is completed when the sheet $P_{B-5}$ is carried to the standby tray 13. When the CPU 51 determines in Act 120 that the discharging the stapled sheet bundle A is not completed when the sheet $P_{B-5}$ is carried to the standby tray 13, the CPU 51, in Act 121, outputs a delay time changing request (delay time changing instruction) to the external image forming unit to change the delay time between the sheet $P_{B-4}$ prior by one sheet to the final sheet in the sheet bundle B to be stapled and the final sheet $P_{B-5}$ to be longer, in order to prevent the sheet $P_{B-5}$ from being carried to the standby tray 13 until the discharging of the sheet bundle A is completed after the sheet bundle A stapled in Act 116 is discharged.

When the CPU 51 determines in Act 120 that the discharging of the stapled sheet bundle A is completed when the sheet $P_{B-5}$ is carried to the standby tray 13, the process of Act 121 is skipped.

Accordingly, when it is determined that the discharging of the stapled sheet bundle A is completed when the sheet $P_{B-5}$ is carried to the standby tray 13, it is not necessary to add the delay time. Accordingly, the time until the sheet bundle B is guided to the processing tray 14 after the sheet bundle A is stapled and discharged is only about T0×7, thereby saving the delay time. Therefore, it is possible to suitably staple the sheets at a high speed using the proper delay time, without deteriorating the performance.

If the CPU 51 determines at the act 120 that the discharging is already completed before the sheet $P_{B-5}$ is carried to the standby tray 13, the standby tray 13 may drops the temporarily held sheet to the processing tray 14 even if a number of the temporarily held sheets does not reach the maximum number of sheets that can be stacked on the standby tray 13. After dropping the temporarily held sheet to the processing tray 14, the standby tray 13 drops following temporarily held sheets individually.

It has been described above that the stapling positions are not changed even when a print job is changed. However, there is no problem when the two-position stapling is continued, but the delay time T2 for the process of stapling two sheets at two positions is taken even when the process of stapling two sheets at two positions is switched to the process of stapling two sheets at one position, thereby adding the extra standby time. Therefore, by using the optimized delay time instead of the delay time T2, the discharging of the sheet bundle A may be completed when the final sheet Pis carried to the standby tray 13, even when the number of positions of the stapling is changed and the stapling is performed at two positions.

The above-mentioned processes described in this embodiment may be executed by software or hardware.

In this embodiment, the operations of the flowchart are carried out in time series in the order of description. However, the operations may not be processed necessarily in time series and may include processes carried out in parallel or individually.

The series of processing described in the embodiments of the invention can be executed by software or by hardware.

Moreover, while the embodiments of the invention describe an example of processing that is carried out in time series in the described order, the processing is not necessarily be carried out in time series and may include processing that is carried out in parallel or individually.

What is claimed is:

1. A finisher comprising:

a standby tray configured to temporarily hold a plurality of sheets to form a first sheet bundle and to drop the first sheet bundle after the first sheet bundle is formed;

a processing tray configured to receive the first sheet bundle dropped from the standby tray;

a stapling unit configured to staple the first sheet bundle on the processing tray;

a discharge unit configured to discharge the first sheet bundle stapled by the stapling unit from the processing tray; and a control unit configured:

to control the standby tray to form a part of a second sheet bundle subsequent to the first sheet bundle until the discharge unit discharges the first sheet bundle, to control the standby tray to receive a sheet of the first sheet bundle and the subsequent sheet of the first sheet bundle within a first period, to control the standby tray to receive the last sheet of the first sheet bundle and a first sheet of the second sheet bundle within a second period as same length as the first period, and to control the standby tray to receive a sheet of the second sheet bundle and the subsequent sheet of the second sheet bundle within a third period that is equal to the first and second periods in time length if the discharge unit has discharged the first sheet bundle and is different from the first and second periods in time length if the discharge unit has not discharged the first sheet bundle.

2. The finisher of claim 1, wherein the sheet of the first sheet bundle is a sheet preceding the last sheet of the first sheet bundle.

3. The finisher of claim 1, wherein the sheet of the second sheet bundle is a sheet preceding the last sheet of the second sheet bundle.

4. The finisher of claim 1, wherein the sheet of the second sheet bundle is a sheet preceding the last sheet of the part of the second sheet bundle.

5. The finisher of claim 1, wherein the control unit controls the standby tray to provide the part of the second sheet bundle to the processing tray after the discharge unit discharges the first sheet bundle, and controls the standby tray to provide the subsequent sheet onto the part of the second sheet bundle to complete the second sheet bundle.

6. The finisher of claim 1, wherein the stapling unit travels to staple a first position of the first sheet bundle after stapling a second position of the first sheet bundle different from the first position.

7. An image forming apparatus comprising:

an image forming unit configured to sequentially form images on a plurality of sheets, respectively;

a standby tray configured to temporarily hold a plurality of sheets conveyed by the conveying unit to form a first sheet bundle and to drop the first sheet bundle after the first sheet bundle is formed;

a processing tray configured to receive the first sheet bundle dropped from the standby tray;

a stapling unit configured to staple the first sheet bundle on the processing tray;

a discharge unit configured to discharge the first sheet bundle stapled by the stapling unit from the processing tray; and a control unit configured to:

control the standby tray to form a part of a second sheet bundle subsequent to the first sheet bundle until the discharge unit discharges the first sheet bundle, to control the image forming unit to output a sheet of the first sheet bundle and the subsequent sheet of the first sheet bundle within a first period, to control the image forming unit to output the last sheet of the first sheet bundle and a first sheet of the second sheet bundle within a second period as same length as the first period, and to control the image forming unit to output a sheet of the second sheet bundle and the subsequent sheet of the second sheet bundle within a third period different from the second period in time length.

8. The image forming apparatus of claim 7, wherein the sheet of the first sheet bundle is a sheet preceding the last sheet of the first sheet bundle.

9. The image forming apparatus of claim 7, wherein the sheet of the second sheet bundle is a sheet preceding the last sheet of the second sheet bundle.

10. The image forming apparatus of claim 7, wherein the sheet of the second sheet bundle is a sheet preceding the last sheet of the part of the second sheet bundle.

11. A sheet conveying method comprising:

holding temporarily a plurality of sheets to form a first sheet bundle on a standby tray;

dropping the first sheet bundle after the sheet bundle is formed;

receiving the first sheet bundle dropped from the standby tray;

forming a part of a second sheet bundle subsequent to the first sheet bundle until discharging the first sheet bundle so that a first period between receiving a sheet of the first sheet bundle and receiving the subsequent sheet of the first sheet bundle is as same length as a second period between receiving the last sheet of the first sheet bundle and receiving a first sheet of the second sheet bundle, and a third period between receiving a sheet of the second sheet bundle and receiving the subsequent sheet of the second sheet bundle is equal to the first and second periods in time length if the first sheet bundle has been discharged and is different from the first and second periods in time length if the first sheet bundle has not been discharged;

stapling the first sheet bundle;

discharging the first sheet bundle; and receiving the second sheet bundle.

* * * * *